US007913325B2

(12) United States Patent
Bullock

(10) Patent No.: US 7,913,325 B2
(45) Date of Patent: Mar. 29, 2011

(54) BICYCLE HELMET WITH REINFORCEMENT STRUCTURE

(75) Inventor: Christopher Bullock, Campbell, CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 407 days.

(21) Appl. No.: 11/425,350

(22) Filed: Jun. 20, 2006

(65) Prior Publication Data

US 2007/0277296 A1 Dec. 6, 2007

Related U.S. Application Data

(60) Provisional application No. 60/801,639, filed on May 19, 2006, provisional application No. 60/801,668, filed on May 19, 2006.

(51) Int. Cl.
*A42B 3/00* (2006.01)

(52) U.S. Cl. ..... 2/412; 2/411; 2/410

(58) Field of Classification Search ..... 2/410–412, 2/414, 416, 421
See application file for complete search history.

(56) References Cited

U.S. PATENT DOCUMENTS

| | | | | |
|---|---|---|---|---|
| 1,522,024 | A * | 1/1925 | Nixon, Jr. | 2/421 |
| 4,901,373 | A | 2/1990 | Broersma et al. | |
| 4,903,350 | A | 2/1990 | Gentes et al. | |
| 5,023,958 | A | 6/1991 | Rotzin | |
| 5,088,130 | A | 2/1992 | Chiarella | |
| 5,119,516 | A | 6/1992 | Broersma | |
| 5,123,121 | A | 6/1992 | Broersma | |
| 5,177,815 | A * | 1/1993 | Andujar | 2/411 |
| 5,269,025 | A | 12/1993 | Broersma | |
| 5,272,773 | A | 12/1993 | Kamata | |
| 5,309,576 | A | 5/1994 | Broersma | |
| 5,351,341 | A | 10/1994 | Broersma | |
| 5,351,342 | A | 10/1994 | Garneau | |
| 5,381,560 | A | 1/1995 | Haltstead et al. | |
| D361,407 | S | 8/1995 | Ho | |
| D361,409 | S | 8/1995 | Ho | |
| D361,410 | S | 8/1995 | Ho | |
| D361,411 | S | 8/1995 | Ho | |
| D363,570 | S | 10/1995 | Ho | |
| 5,477,563 | A | 12/1995 | Gentes | |
| D366,538 | S | 1/1996 | Ho | |

(Continued)

FOREIGN PATENT DOCUMENTS

| | | |
|---|---|---|
| EP | 0 581 460 | 2/1994 |

(Continued)

OTHER PUBLICATIONS

Kipp, Dale, Plastic Material Data Sheets, 2004 MatWeb—Division of Automation Creation, Inc. (via Knovel.com).*

(Continued)

*Primary Examiner* — Shaun R Hurley
*Assistant Examiner* — Andrew W Sutton
(74) *Attorney, Agent, or Firm* — Knobbe Martens Olson & Bear, LLP

(57) ABSTRACT

A bicycle helmet has a body with a concave inner surface configured to permit the helmet to fit a user's head. The body has a first section with a first density and a second section with a second density different from the first density. A reinforcement structure is disposed in the body, wherein the reinforcement structure engages the first and second portions of the body.

29 Claims, 23 Drawing Sheets

U.S. PATENT DOCUMENTS

| | | | | |
|---|---|---|---|---|
| 5,481,762 | A | 1/1996 | Gentes | |
| 5,519,895 | A | 5/1996 | Barnes, Jr. | |
| 5,551,094 | A | 9/1996 | Navone | |
| 5,581,819 | A | 12/1996 | Garneau | |
| 5,598,588 | A | 2/1997 | Lee | |
| 5,619,756 | A | 4/1997 | Garneau | |
| 5,745,923 | A | 5/1998 | Katz | |
| 5,794,271 | A | 8/1998 | Hastings | |
| 5,794,272 | A | 8/1998 | Workman et al. | |
| 5,867,840 | A | 2/1999 | Hirosawa | |
| 5,887,288 | A | 3/1999 | Arney et al. | |
| 5,915,537 | A | 6/1999 | Dallas et al. | |
| 5,950,244 | A * | 9/1999 | Fournier et al. | 2/414 |
| 6,012,178 | A | 1/2000 | Shuster | |
| 6,029,269 | A | 2/2000 | El-Soudani | |
| 6,070,271 | A | 6/2000 | Williams | |
| 6,292,952 | B1 | 9/2001 | Watters | |
| 6,292,954 | B1 * | 9/2001 | O'Bradaigh et al. | 2/424 |
| 6,343,385 | B1 | 2/2002 | Katz | |
| 6,401,261 | B1 | 6/2002 | Arney et al. | |
| 6,425,141 | B1 | 7/2002 | Ewing | |
| 6,425,142 | B2 | 7/2002 | Sasaki et al. | |
| 6,532,602 | B2 | 3/2003 | Watters | |
| 6,550,071 | B2 | 4/2003 | Garneau | |
| 6,604,246 | B1 * | 8/2003 | Obreja | 2/411 |
| D482,501 | S | 11/2003 | Ho | |
| D495,835 | S | 9/2004 | Ho | |
| D495,836 | S | 9/2004 | Fang | |
| 7,069,601 | B1 | 7/2006 | Jacobsen | |
| 2001/0022005 | A1 | 9/2001 | Sasaki et al. | |
| 2002/0023291 | A1 | 2/2002 | Mendoza | |
| 2002/0124298 | A1 * | 9/2002 | Muskovitz | 2/410 |
| 2003/0139104 | A1 | 7/2003 | Arai | |
| 2003/0221245 | A1 | 12/2003 | Lee et al. | |
| 2004/0025229 | A1 * | 2/2004 | Takahashi et al. | 2/412 |
| 2006/0248630 | A1 | 11/2006 | Bullock | |
| 2007/0220662 | A1 | 9/2007 | Pierce | |
| 2008/0141429 | A1 * | 6/2008 | Scharpenack et al. | 2/2.5 |

FOREIGN PATENT DOCUMENTS

| | | |
|---|---|---|
| WO | WO 95/01739 | 1/1995 |

OTHER PUBLICATIONS

Search Report for European Patent Application No. EP 06 00 7608, dated Jun. 27, 2006.

U.S. Appl. No. 11/425,331, filed Jun. 20, 2006, Bullock.

European Search report received in European Application No. 07 00 9830.

First Office Action mailed on Jan. 29, 2010 received in related Chinese Application No. 200710104954.7.

* cited by examiner

BICYCLE HELMET WITH REINFORCEMENT STRUCTURE

CROSS-REFERENCE TO RELATED APPLICATIONS

This application claims the benefit of U.S. Provisional Application No. 60/801,639, filed May 19, 2006, titled BICYCLE HELMET WITH REINFORCEMENT STRUCUTRE, and the benefit of U.S. Provisional Application No. 60/801,668, filed May 19, 2006, titled BICYCLE HELMET WITH REINFORCEMENT STRUCUTRE, the entire contents of both of which are incorporated by reference and should be considered a part of this specification.

BACKGROUND OF THE INVENTION

1. Field of the Invention

The present invention relates to protective helmets and bicycle helmets in particular. More specifically, the present invention relates to a helmet with multiple-density foam parts interconnected by a reinforcement structure.

2. Description of the Related Art

Conventional bicycle helmets typically employ a layer of crushable material, usually synthetic resin foam, extending over and about the wearer's head to mitigate the force of an impact, for example, due to a fall. In order to increase the impact strength of the helmet, manufacturers of conventional helmets usually increase the thickness or the density of the crushable material. However, both these approaches tend to increase the overall weight of the helmet. Additionally, increasing the thickness of the layer of crushable material makes the helmet more bulky.

Accordingly, there is a need for a helmet design that provides increased impact strength without increasing the overall weight of the helmet.

SUMMARY OF THE INVENTION

Preferred embodiments of the present invention provide an improved bicycle helmet and methods of making the same. Preferably, the improved helmet includes a body with multiple foam sections having different densities, the foam sections interconnected at least in part by a reinforcement structure.

In accordance with one embodiment, a bicycle helmet is provided comprising a body having a concave inner surface configured to permit the helmet to fit a user's head. The body has a first section with a first material density and a second section with a second material density different from the first material density. The helmet also comprises a reinforcement structure disposed in the body, wherein the reinforcement structure engages the first and second sections of the body.

In accordance with another embodiment, a bicycle helmet is provided comprising a body having a plurality of sections, a first material density of one of the sections being different from a second material density of another of the sections. The helmet also comprises a reinforcement structure, at least a portion of which is embedded within said body, wherein the reinforcement structure extends through adjacent sections so that the sections are interconnected at least partially by the reinforcement structure.

In accordance with yet another embodiment, a bicycle helmet is provided comprising a body having a first section having a first material density and a second section having a second material density different from the first material density. The helmet also comprises a reinforcement structure comprising at least one shell attached to the first and second sections, wherein the reinforcement structure extends across the sections so that the sections are interconnected at least partially by the reinforcement structure.

In accordance with still another embodiment, a method for manufacturing a bicycle helmet is provided, comprising forming a first body section having a first material density, the first section engaging at least a portion of a reinforcement structure. The method also comprises forming a second body section having a second material density different than the first material density. The second body section engages the first body section and at least a portion of the reinforcement structure, and the reinforcement structure interconnects the first and second body sections.

BRIEF DESCRIPTION OF THE DRAWINGS

These and other features, aspects and advantages of the present protective helmet are described in greater detail below with reference to several preferred embodiments, which are intended to illustrate, but not to limit the present invention. The drawings contain 24 figures.

DETAILED DESCRIPTION OF THE PREFERRED EMBODIMENT

Figure 1A:
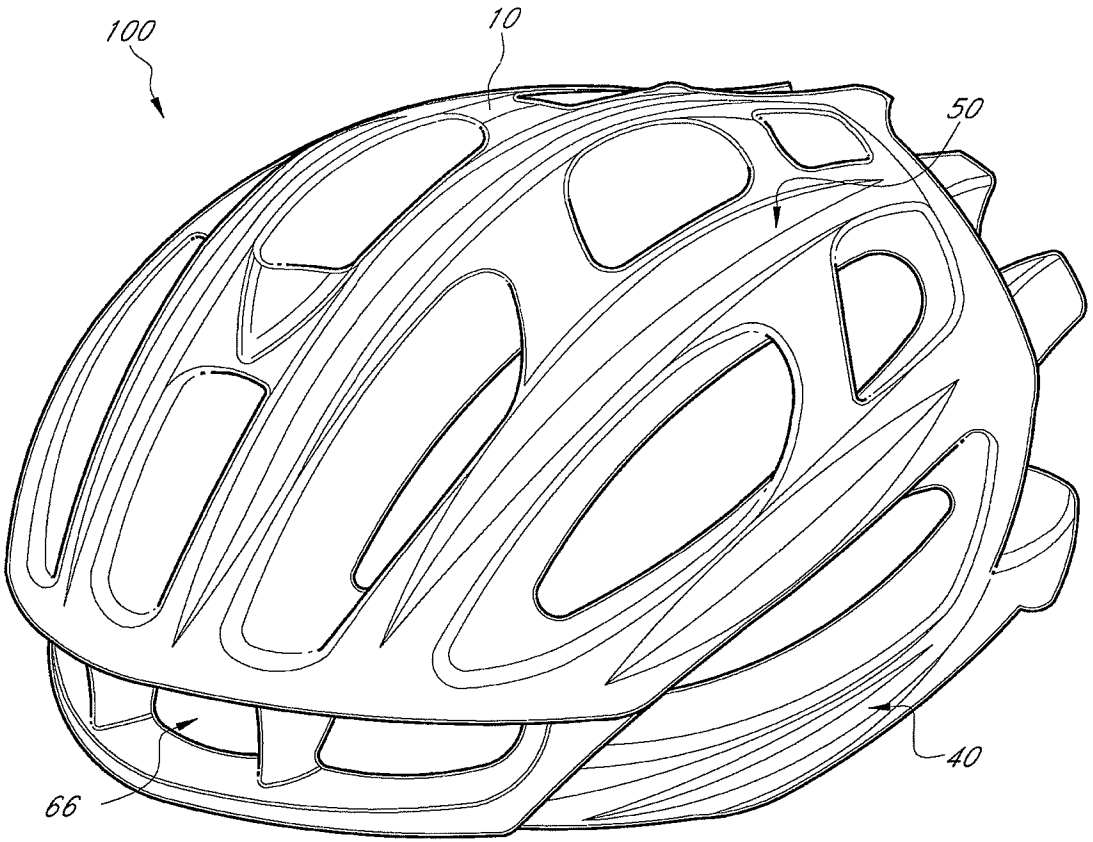
FIG. 1A is a schematic front perspective view of a bicycle helmet incorporating one embodiment of a reinforcement structure.

In the following detailed description, terms of orientation such as "top," "bottom," "upper," "lower," "front," "rear," "left," "right" and "center" are used herein to simplify the description of the context of the illustrated embodiments. Likewise, terms of sequence, such as "first" and "second," are used to simplify the description of the illustrated embodiments. However, because other orientations and sequences are possible, the present invention should not be limited to the illustrated orientation. Those skilled in the art will appreciate that other orientations of the various components described above are possible. As used herein, "front", "rear", "left" and "right" are interpreted from the point of view of a user of a protective helmet. Likewise, "top", "bottom", "upper" and "lower" are interpreted from the point of view of the wearer of the helmet.

FIGS. 1A-1E illustrate one preferred embodiment of a protective helmet, which is especially well suited for use as a bicycle helmet 100. The helmet 100 includes a body 10, which preferably is a composite structure. The helmet body 10 preferably makes up the protective, impact resistant portion of the helmet 100. In the illustrated arrangement, the body 10 includes a front end 12, a rear end 14, a bottom edge 16 and a top end 18. Additionally, the body includes a left side 20 and a right side 30. The helmet body 10 also preferably defines a cavity sized to permit the body 10 to fit on a user's head. For example, the cavity can have a concave surface that at least partially surrounds a portion of the user's head when wearing the helmet 100. In one preferred embodiment, the body 10 is sized so that the bottom edge 16 on the left and right sides 20, 30 sits proximal the user's ears, and so the rear end 14 sits at or below the user's skull when wearing the helmet 100. Further, as known in the art, the helmet body 10 can have a variety of sizes in order to fit the variety of head-sizes in the user population. For example, in one embodiment the helmet 100 can be sized to fit children. In another embodiment, the helmet 100 can be sized to fit adults. In still another embodiment, the helmet 100 can be sized to fit a range of head sizes.

Figure 1B:
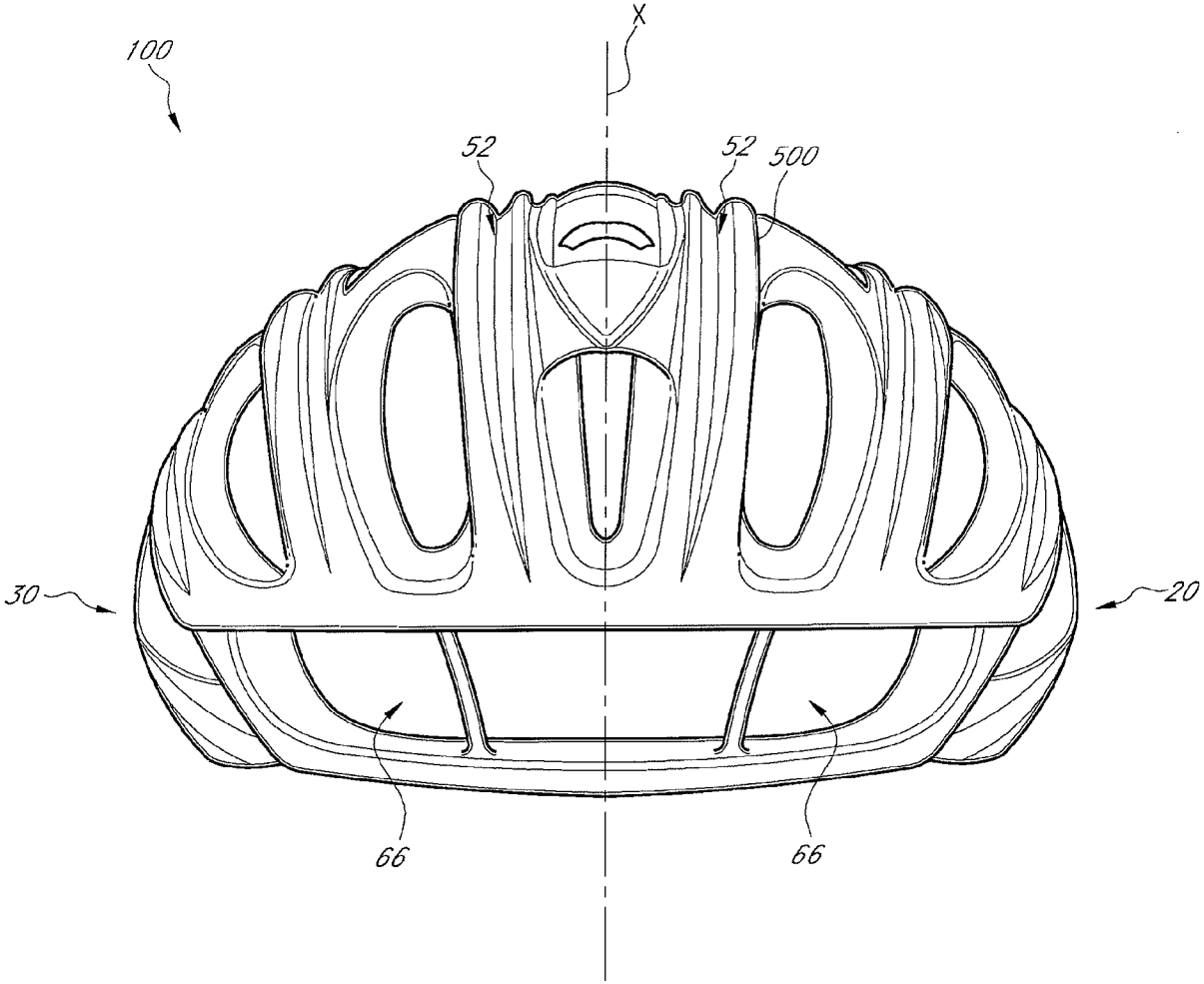
FIG. 1B is a schematic front view of the bicycle helmet in FIG. 1A.
Figure 1C:
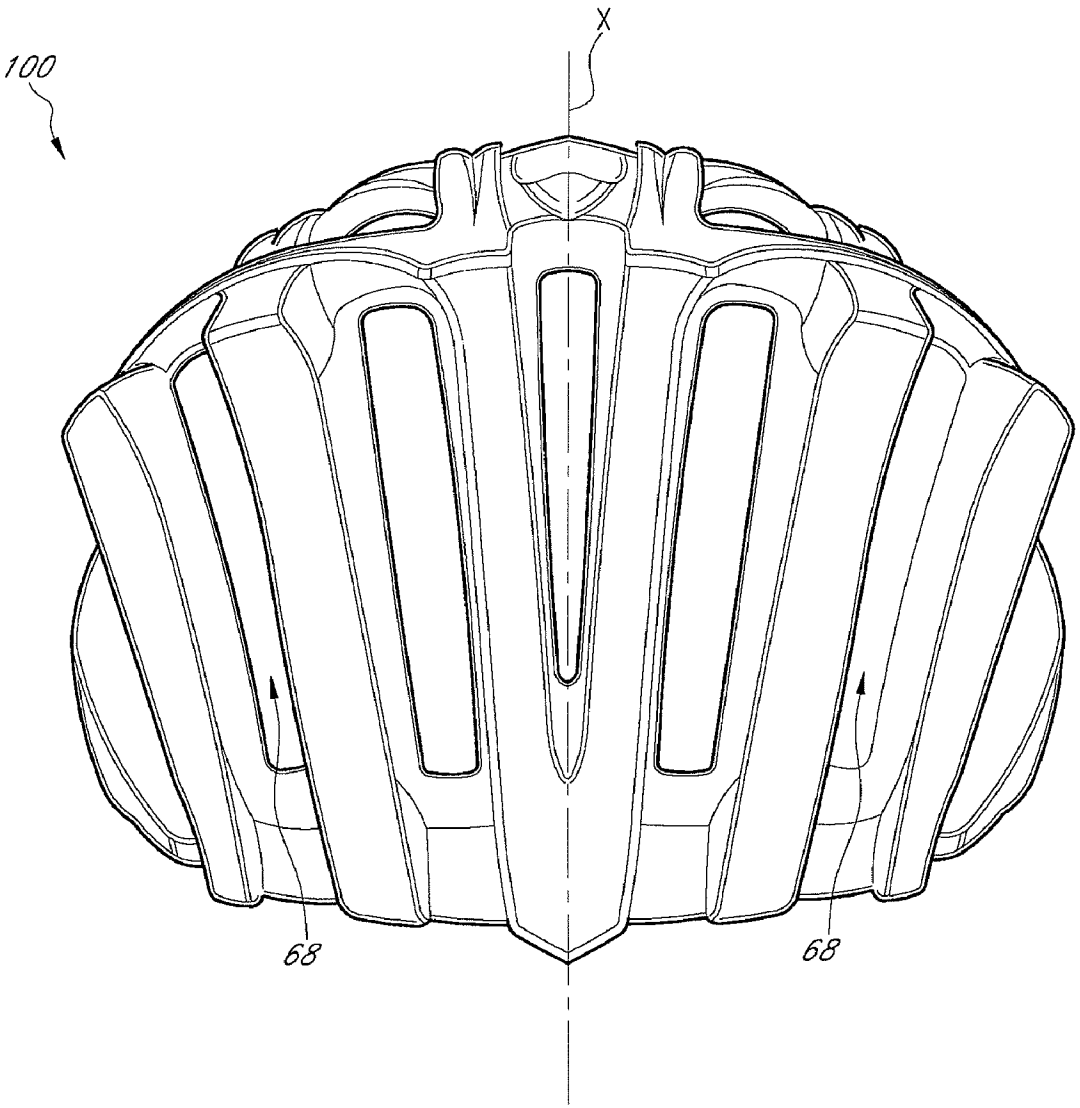
FIG. 1C is a schematic rear view of the bicycle helmet in FIG. 1A.

The helmet body 10 preferably defines a bottom section 40 and a top section 50. In the illustrated embodiment, the bottom section 40 is defined below a dotted line (See FIG. 1D) and extends from the rear end 14 to a point P proximal the front end 12 of the body 10. The helmet body 10 is preferably symmetrical about a longitudinal axis X, as shown in FIGS. 1B, 1C and 1F, so that the left side 20 and right side 30 of the body 10 are mirror images of each other. In another embodiment, the bottom section 40 extends from the rear end 14 to the front end 12.

With continued reference to FIGS. 1A-1E, a number of openings 60 are formed in the helmet body 10, where the openings 60 are configured to allow air to flow therethrough to advantageously cool the head of a user wearing the helmet 100. In the illustrated embodiment, the helmet body 10 has at least one air opening 62 formed between the bottom and top sections 40, 50 of the body 10. In the illustrated embodiment, two openings 62 are formed at a boundary between the bottom and top sections 40, 50. The openings 62 are preferably elongated and are arranged in a longitudinal direction between the front end 12 and the rear end 14 of the body 10. Additionally, a recess 62*a* in the body 10 is disposed adjacent each opening 62 and configured to guide air toward the opening 62. However, the openings 62 can be arranged in other suitable patterns.

Figure 1D:
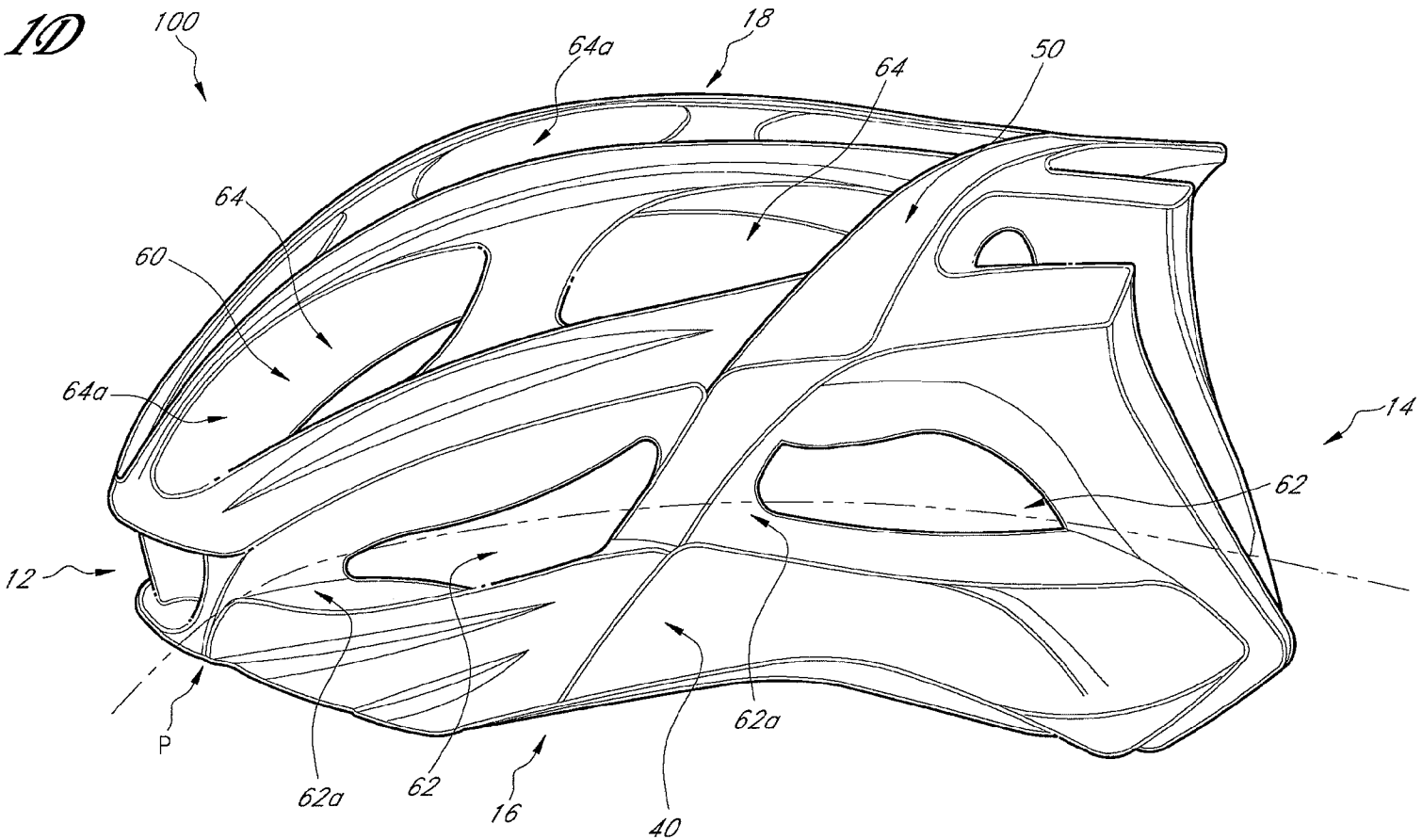
FIG. 1D is a schematic left-side view of the bicycle helmet in FIG. 1A.
Figure 1E:
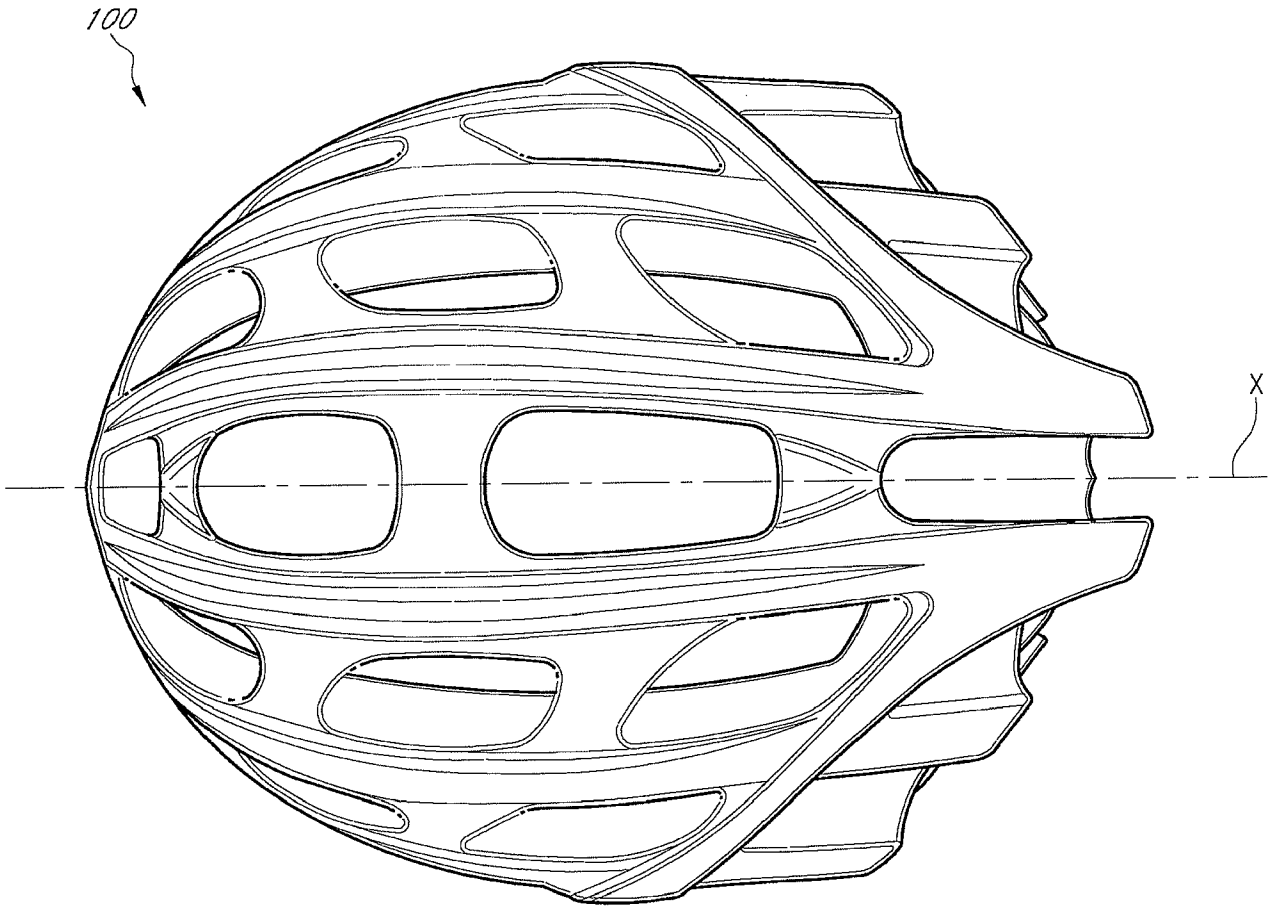
FIG. 1E is a schematic top view of the bicycle helmet in FIG. 1A.

FIG. 1D also illustrates a plurality of openings 64 formed in the top section 50 of the body 10. Preferably, the openings 62, 64 are sized to direct a desired amount of airflow to a user's head. The openings 64 are likewise elongated and arranged in a longitudinal direction between the front end 12 and the rear end 14 of the body 10. However, the openings 64 can be arranged in other suitable patterns. The top section 50 also has recesses 64a formed therein, one of said recesses 64a disposed adjacent each opening 64. As discussed above, the recesses 64a are configured to guide airflow to the openings 64 and onto a user's head. The top section 50 includes at least one elongated support member 52 between adjacent series of openings 64. The support member 52 preferably extends longitudinally between the front end 12 and the rear end 14 of the helmet body 10.

The body 10 also has an opening 66 formed at the front end 12 thereof. In the illustrate embodiment, three openings 66 are shown. However, any the body 10 can have any suitable number of openings 66. The opening 66 preferably defines a slot above the bottom edge 16 that extends laterally from the left side 20 to the right side 30 of the body 10. Preferably, the opening 66 allows air to flow therethrough at least partially onto a user's forehead when the helmet 100 is worn by the user. In one embodiment, the body 10 also preferably has an opening 68 formed at the rear end 14 thereof, as shown in FIG. 1C. In the illustrated, the body 10 has three openings 66 at the front end 12 and five openings 68 at the rear end 14. In another embodiment, more or fewer than three openings 66 can be provided at the front end 12 and more or fewer than five openings 68 can be provided at the rear end 14. In the illustrated embodiment, the openings 66 at the front end 12 are elongated and extend between the left and right sides 20, 30 of the helmet body 10. Likewise, the openings 68 at the rear end 14 are preferably elongated.

The helmet body 10 is preferably manufactured with an energy absorbing material, such as an expanded foam material. However, other suitable materials may also be used. More preferably, the helmet body 10 is constructed of different parts of expanded foam material, each part having a different foam density. In the illustrated embodiment, the bottom section 40 defines one part having a first foam density and the top section 50 defines a second part having a second foam density different than the first foam density. In one embodiment, the first foam density is greater than the second foam density. In another embodiment, the second foam density is greater than the first foam density. In still another embodiment, the bottom section 40 defines a plurality of foam parts, each having a different foam density. Likewise, in another embodiment the top section 50 defines a plurality of foam parts, each having a different foam density. Advantageously, the helmet body 10 constructed with said areas of different foam density provides a lighter helmet 100, while satisfying the impact resistance standards of the helmet 100. In a preferred embodiment, the helmet body 10 has a first foam density of between about 60 grams/liter and about 112 grams/liter. In another embodiment, the first foam density is between about 98 grams/liter and about 112 grams/liter. In still another embodiment, the first foam density is about 104 grams/liter. In another embodiment, the helmet body 10 has a second foam density of between about 60 grams/liter and about 112 grams/liter. In another embodiment, the second foam density is between about 60 g grams/liter and bout 98 grams/liter. In still another embodiment, the second foam density is about 72 grams/liter.

Figures 2A, 2B:
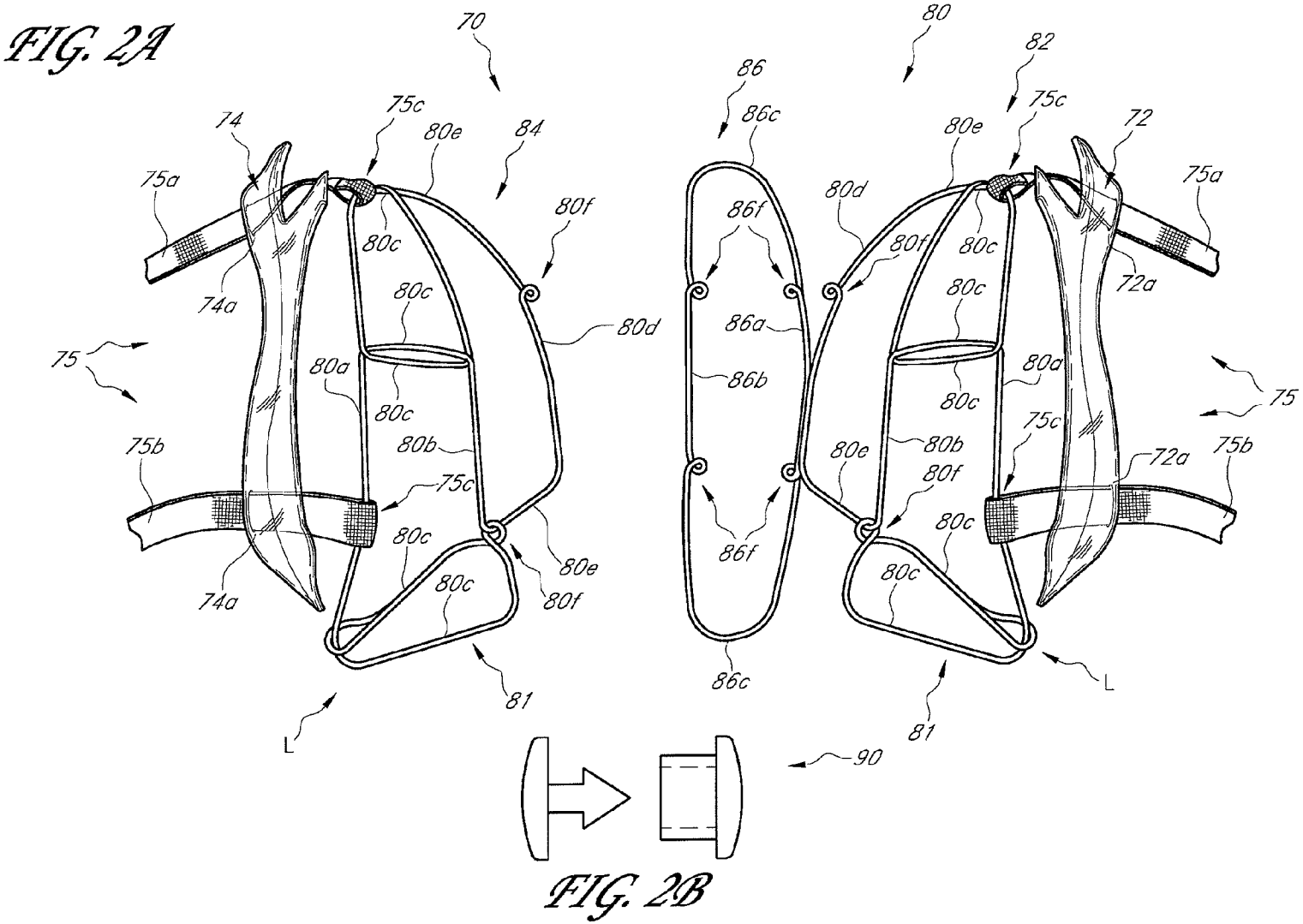
FIG. 2A is a schematic side view of one embodiment of a reinforcement structure used for manufacturing the bicycle helmet of FIG. 1A.
FIG. 2B is a schematic side view of one embodiment of a fastener used to interconnect different parts of the reinforcement structure in FIG. 2A.

FIG. 2A illustrates one embodiment of a frame 70 for use in constructing a helmet, such as the helmet 100 discussed above. The frame 70 preferably includes a tray having a cavity sized to receive foam thereabout, as further described below. In the illustrated embodiment, the frame 70 includes a right-side tray 72 and a left-side tray 74. In a preferred embodiment, the right-side and left-side trays 72, 74 are mirror images of each other. In one embodiment, the trays 72, 74 are made of a plastic material. However, the trays 72, 74 can be made of other suitable light-weight materials. Preferably, the trays 72, 74 have a shape corresponding to the section of the helmet body 10 to be molded. In the illustrated embodiment, the right and left trays 72, 74 have the same shape as the right and left sides of the bottom section 40 of the helmet body 10, respectively.

The right-side and left-side trays 72, 74 preferably include openings 72*a*, 74*a*, respectively, through which straps 75 can extend. The straps 75 can be made of nylon or other suitable materials for use with protective helmets. Additionally, the straps 75 can be arranged to securely fasten the constructed helmet 100 on a user's body. For example, the straps can include front straps 75*a* and rear straps 75*b*, wherein the front and rear straps 75*a*, 75*b* together maintain the constructed helmet 100 in generally fixed relationship to the user's head. The straps 75*a*, 75*b* of the right-side and left-side trays 72, 74 can be fastened to each other in any suitable manner to maintain the constructed helmet generally in place on a user's head. Each of the straps 75*a*, 75*b* preferably has a closed end 75*c* at one end thereof. In the illustrated embodiment, the closed end 75*c* of the strap 75*a*, 75*b* is disposed in the cavity of the tray 72, 74. In one embodiment, the closed end 75*c* includes a passage defined by portions of the strap 75*a*, 75*b* fastened together with stitches. However, the closed end 75*c* can be defined by fastening the strap 75*a*, 75*b* in other suitable ways, such as with an adhesive.

With continued reference to FIG. 2A, the frame 70 includes a reinforcement structure 80. In the illustrated embodiment, the reinforcement structure 80 includes a structure of flexible linear material 81. For example, in one arrangement, the reinforcement structure 80 includes a structure of composite material, preferably having unidirectional fiber orientation. One suitable flexible linear material reinforcement structure is discussed in co-pending application Ser. No. 11/425,331, titled BICYCLE HELMET WITH REINFORCEMENT STRUCTURE and filed on Jun. 20, 2006, the entire contents of which are hereby incorporated by reference and should be considered a part of this specification. However, the reinforcement structure 80 can additionally or alternatively include other suitable structures, such as reinforcement shells or panels, as further discussed below. In the illustrated embodiment, the reinforcement structure 80 includes a right-side frame 82, a left-side frame 84 and a top frame 86. In one preferred embodiment, the frames 82, 84, 86 are defined by a continuous filament. In another embodiment, the reinforcement structure 80 can consist of the right-side frame 82 and the left-side frame 84, without a top frame 86.

In the illustrated embodiment, the right-side and left-side frames 82, 84 preferably have a same layout L. Accordingly, the following description of the layout L is applicable to both the right-side and left-side frames 82, 84. The layout L preferably includes a plurality of elongated members, with at least one extending longitudinally along at least a portion of the length of the tray 72, 74 and at least one extending generally transverse thereto. In the illustrated embodiment, the layout L includes a first elongated member 80*a* extending generally longitudinally along substantially the entire length of the tray 72, 74. As shown in FIG. 2A, the first elongated member 80*a* extends through the passages in the straps 75*a*, 75*b*. Accordingly, the straps 75*a*, 75*b* are coupled to the reinforcement structure 80 via the first elongated members 80*a*. The layout L also includes a second elongated member 80*b* extending generally longitudinally along substantially the entire length of the tray 72, 74 and generally parallel to the first elongated member 80*a*. The second elongated member 80*b*preferably attaches to the first elongated member 80*a* via transverse members 80*c* extending therebetween. The layout L also includes a third elongated member 80*d* extending generally longitudinally along a portion of the length of the tray 72, 74 and generally parallel to the second elongated member 80*b*. The third elongated member 80*d* preferably attaches to the second elongated member 80*b* via second transverse members 80*e* extending therebetween. As shown in FIG. 2A, the layout also includes junctions 80*f* along the length of the second and third elongated members 80*b*, 80*d*, as well as at a junction between the second elongated member 80*b* and the transverse members 80*c*, 80*e*. Preferably, the elongated members 80*a*, 80*b*, 80*d* and transverse members 80*c*, 80*e* at least partially define the openings 60 in the completed helmet body 10.

Figure 3:
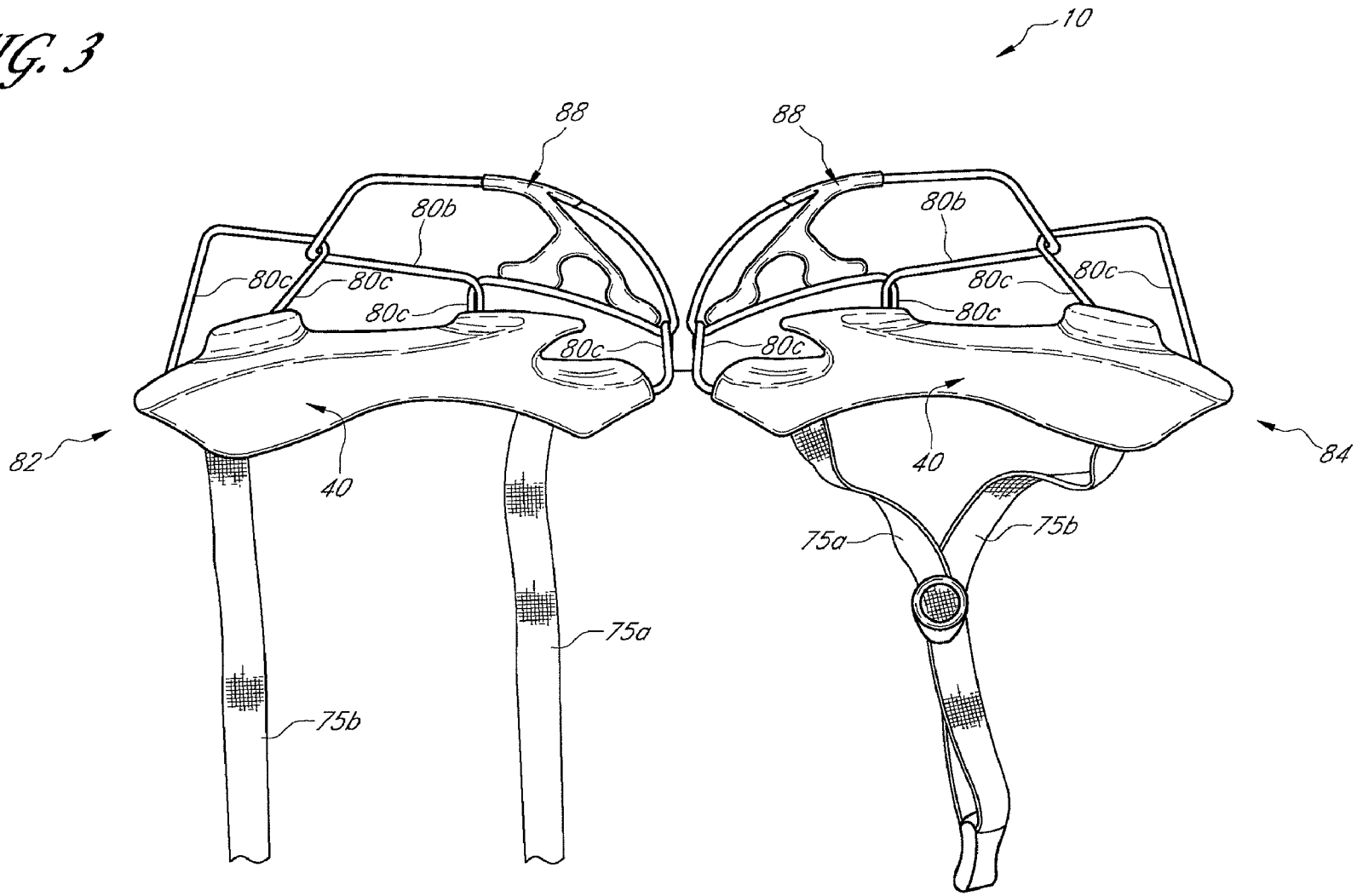
FIG. 3 is a schematic side view of a partially formed bicycle helmet with a bottom foam portion of a pre-selected density molded about the reinforcement structure of FIG. 2A.
Figure 4A:
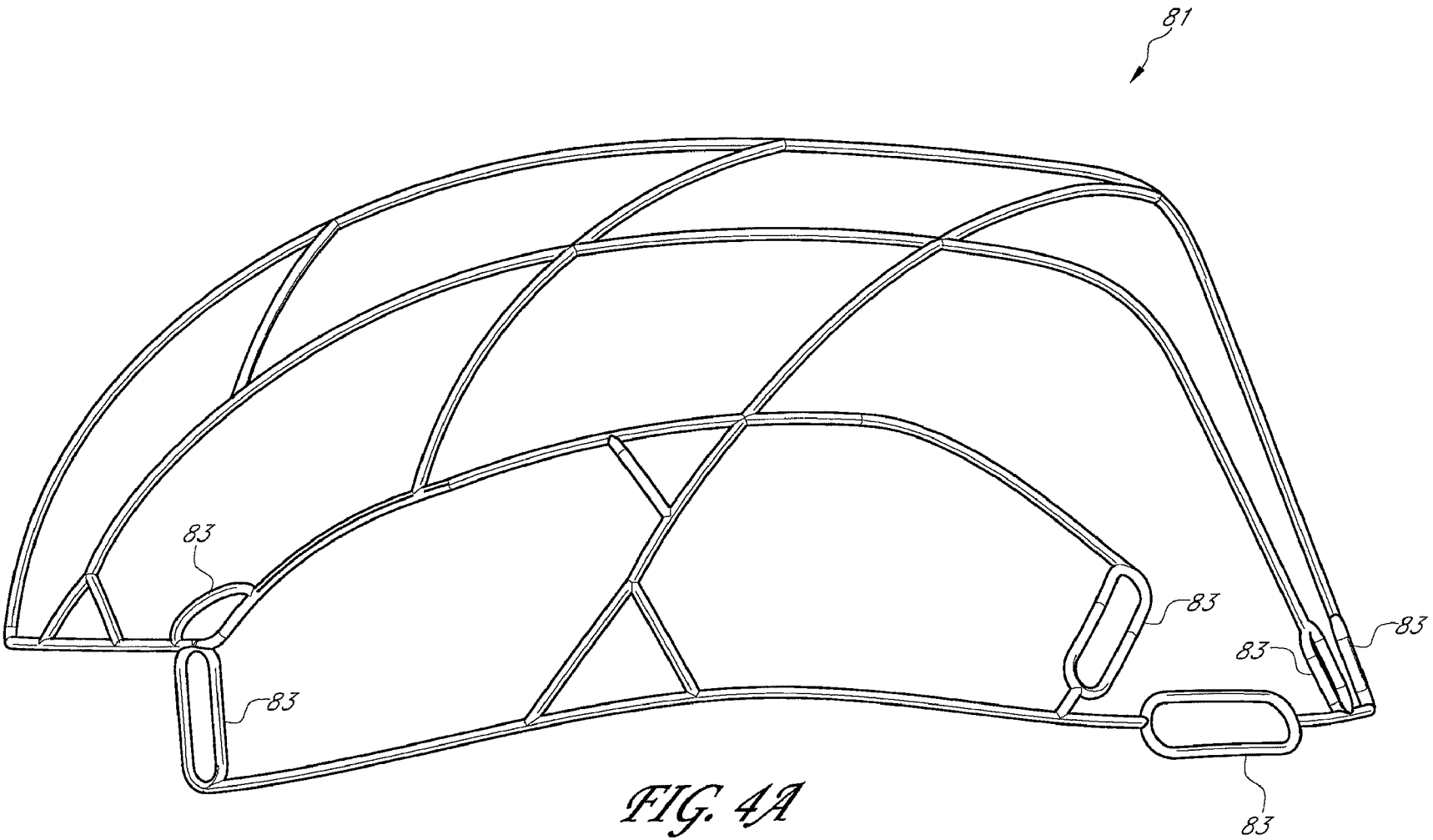
FIG. 4A is a schematic side view of another embodiment of a reinforcement structure used for manufacturing the bicycle helmet of FIG. 1A.
Figure 4B:
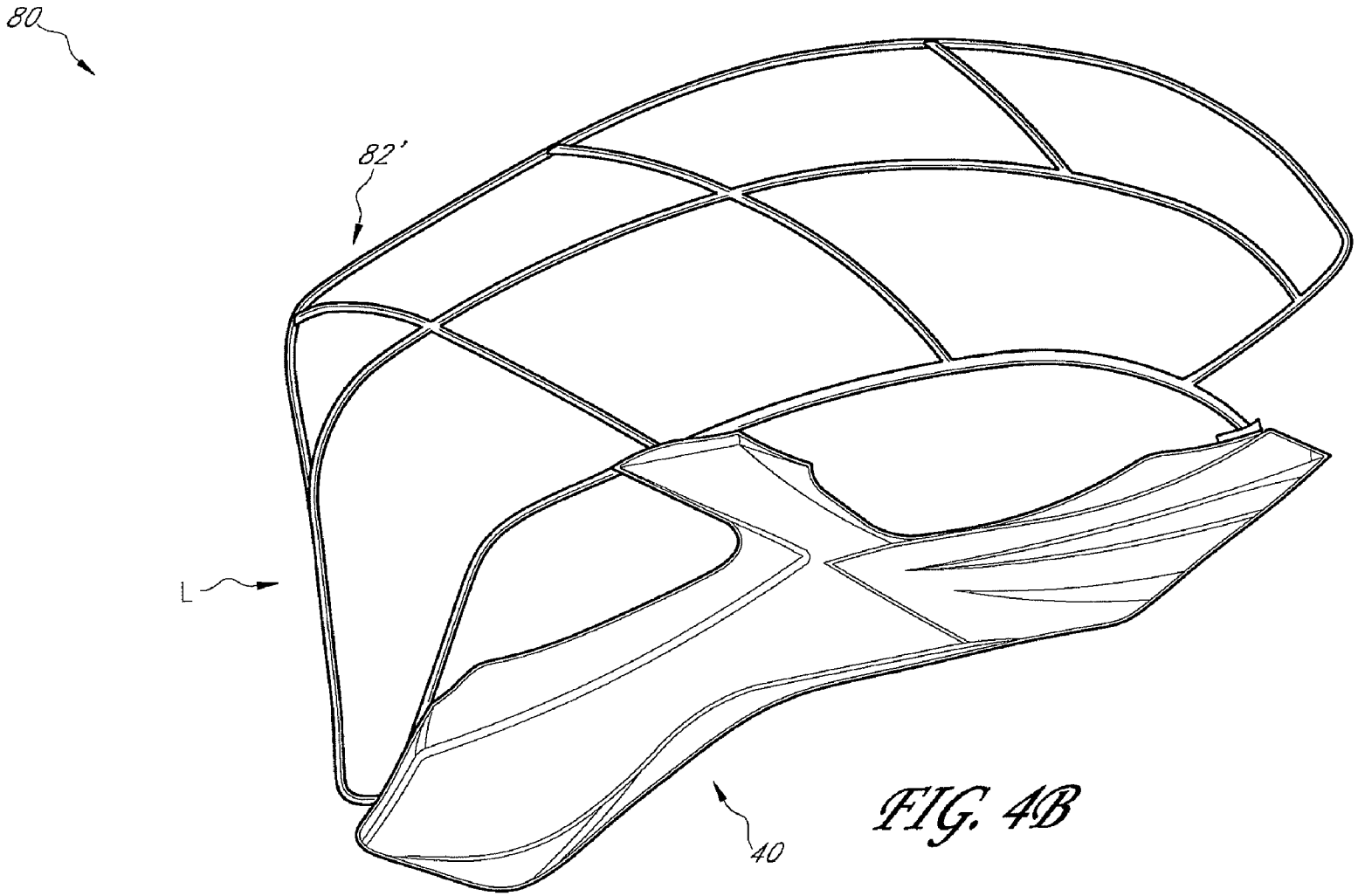
FIG. 4B is a schematic side view of another embodiment of a reinforcement structure used for manufacturing the bicycle helmet of FIG. 1A during an intermediate manufacturing step, the structure having the bottom foam portion molded thereon.
Figure 4C:
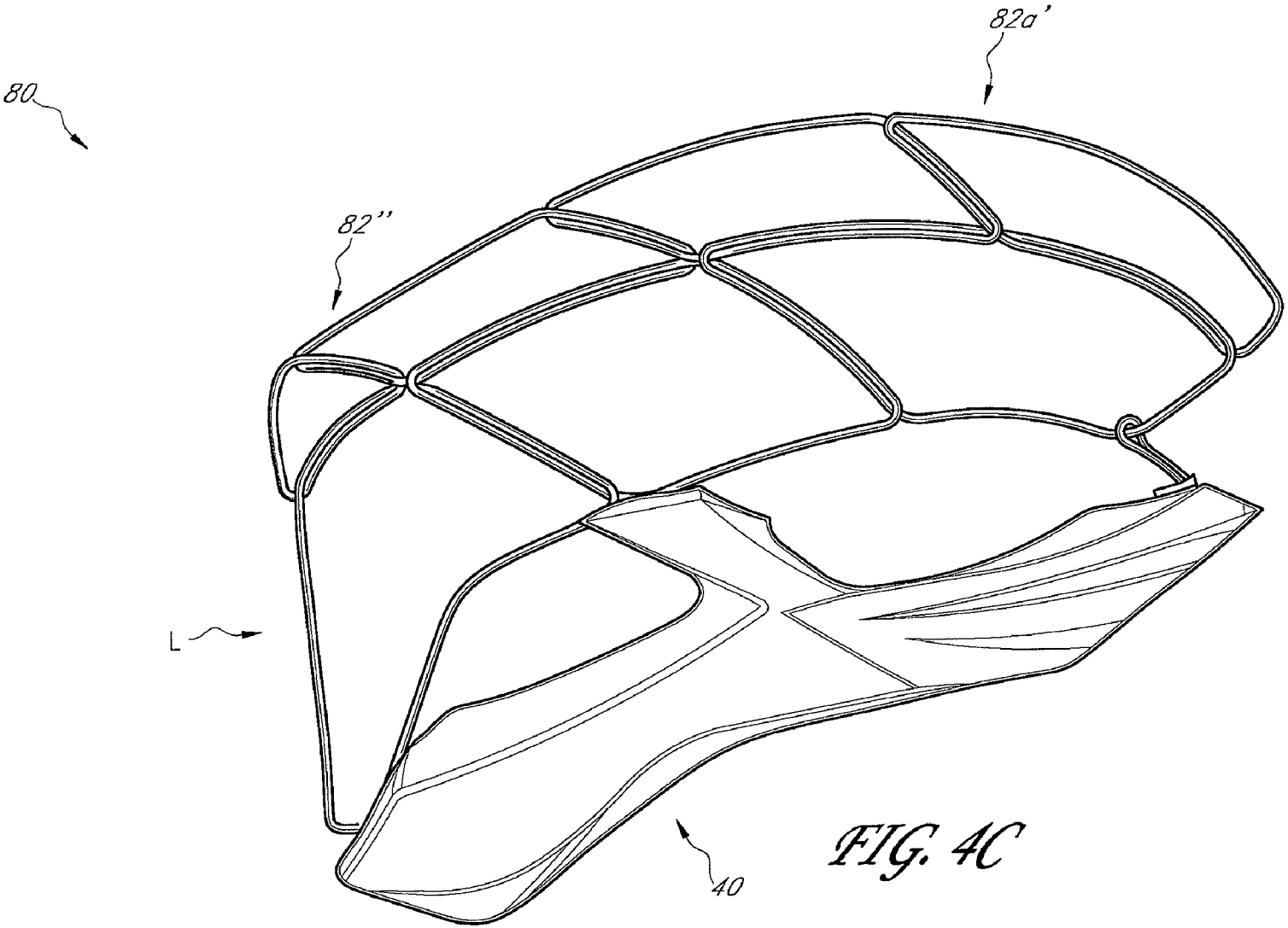
FIG. 4C is a schematic side view of another embodiment of a reinforcement structure used for manufacturing the bicycle helmet of FIG. 1A during an intermediate manufacturing step, the structure having the bottom foam portion molded thereon.

In one embodiment, a reinforcement member 88 extends between the third elongated member 80*d* and the second elongated member 80*b* (see FIG. 3). The reinforcement member 88 is preferably positioned proximal a front end of the layout L. In the illustrated embodiment, the reinforcement member 88 has an upside-down Y shape. However, the reinforcement member 88 can have other suitable shapes. Advantageously, the reinforcement member 88 provides additional stiffness to the right-side and left-side frames 82, 84. Preferably, the reinforcement member 88 is made of a light-weight and stiff material, such as a hard plastic. In one embodiment, the reinforcement member 88 fastens to the right-side and left-side frames 82, 84 via the junctions 80*f* , as further described below. In other embodiments, other suitable mechanisms can be used to fasten the reinforcement member 88 fastens to the right-side and left-side frames, such as an adhesive. However, the reinforcement member 88 is optional, and in other embodiments the reinforcement structure 80 can be constructed without the use of such a reinforcement member 88, as shown in FIGS. 4A-4C below.

In one embodiment, shown in FIG. 2A, the elongated members 80*a*, 80*b*, 80*d* and transverse members 80*c*, 80*e* are preferably made of a single unidirectional linear material, which can be a single continuous filament. For example, the linear material can be shaped to define the elongated members 80*a*, 80*b*, 80*c* and the transverse members 80*c*, 80*e*. In one embodiment, the linear material is bent or twisted to form said members 80*a*-80*e*. Additionally, the linear material can be bent or twisted to form the junctions 80*f*. For example, the linear material can be looped onto itself to form said junctions 80*f*. However, in other embodiments, the reinforcement structure 80 can consists of a plurality of individual sections that overlap each other. For example, the reinforcement structure 80 can consist of a number of loops made of unidirectional linear material, wherein the loops overlap each other to define the layout of the reinforcement structure 80, as shown in FIG. 4C and discussed further below.

In the illustrated embodiment, the reinforcement structure 80 also includes a top frame 86, as shown in FIG. 2A, though as noted above, the top frame 86 is optional. The top frame 86 preferably has an elongated shape and includes a first elongated member 86*a* and a second elongated member 86*b*. Both members 86*a*, 86*b* extend generally longitudinally and are attached to each other via generally transverse members 86*c*. In the illustrated embodiment, the top frame 86 has a generally oval shape. However, the top frame 86 can have other suitable shapes, such as rectangular. The top frame 86 also preferably defines at least one junction 86f along the elongated members 86*a*, 86*b*. In the illustrated embodiment, the top frame 86 defines four junctions 86*f*, two along the first elongated member 86*a* and two along the second elongated member 86*b*. However, the top frame 86 can have any suitable number of junctions 86*f*.

In one embodiment, the right-side and left-side frames 82, 84 are attached to the top frame 86 via the junctions 80*f*, 86*f*. For example, in one embodiment the junctions 80*f* on the second elongated member 80*b* of the right-side frame 82 can be attached to the junctions 86*f* on the first elongated member 86*a* of the top frame 86. Additionally, in one embodiment the junction 80*f* on the third elongated member 80*d* of the right-side frame 82 can be attached to one of the junctions 86*f* on the second elongated member 86*b* of the top frame 86. Likewise, in one embodiment the junctions 80*f* on the second elongated member 80*b* of the left-side frame 84 can be attached to the junctions 86*f* on the second elongated member 86*b* of the top frame 86. Additionally, in one embodiment the junction 80*f* on the third elongated member 80*d* of the left-side frame 84 can be attached to one of the junctions 86*f* on the first elongated member 86*a* of the top frame 86. However, the right-side and left-side frames 82, 84 can be fastened to the top frame 86 using any suitable combination of junctions 80*f*, 86*f*. For example, in another embodiment, the top frame 86 can be fastened to the second elongated members 80*d* of the right-side and left-side frames 82, 84 via the junctions 80*f*, 86*f*.

The junctions 80*f*, 86*f* can be attached with a fastener. For example, the junctions 80*f*, 86*f* can be fastened together with a rivet, such as the snap rivet 90 shown in FIG. 2B. However, other types of rivets and other types of fasteners can also be used, such as screws, clamps, pins, nails and the like. Preferably, the fasteners are made of a rigid and light-weight material. In one embodiment, the fasteners are made of a hard plastic, such as polyethylene. In another embodiment, the junctions 80*f*, 86*f* can be fastened together via an adhesive. Once fastened together, the right-side frame 82, left-side frame 84 and top frame 86 define an assembled reinforcement structure 80.

FIG. 3 illustrates a partially formed helmet body 10. Specifically, FIG. 3 shows right and left bottom foam portions 40 of the right-side and left-side frames 82, 84. In the illustrated embodiment, the helmet body 10 is injection molded about the bottom portions of the right-side and left-side frames 82, 84, as well as about the right-side and left-side trays 72, 74. The foam molding process is can be any process known in the art. One suitable process is discussed further below with reference to FIGS. 6A-7B, which illustrate one embodiment of a mold used to form the foam portions about the right and left side frames 82, 84. Preferably, the first elongated member 80*a*, and at least a portion of the transverse members 80*c* connecting the first and second elongated members 80*a*, 80*b* are insert molded into said bottom foam portions, while the remainder of the right-side and left-side frames 82, 84 remain exposed. As used herein, "insert molded" means embedding at least a portion of the reinforcement structure 80 in foam so that the foam envelops said portion of the structure 80. In another embodiment, a different portion of the right-side and left-side frames 82, 84 can be insert molded or embedded in the foam portion. For example, in one embodiment said first and second elongated members 80*a*, 80*b* and transverse members 80*c* can be substantially entirely embedded within the bottom foam portions. In one embodiment, the right and left sides of the partially formed helmet body 10 are removed from the mold so that the bottom portions are allowed to partially stiffen. In another embodiment, the bottom portions are allowed to fully harden. The partially formed helmet body 10 can then be inserted into another mold, and the injection molding process resumed to form the remaining portion of the helmet body 10. For example, foam can be molded onto the exposed portions of the right-side and left-side frames 82, 84 to form the top section 50 of the completed helmet body 10, as shown in FIGS. 1A-1E.

In one embodiment, the bottom foam portions form the bottom section 40 of the helmet body 10 and interconnect with the subsequently formed top section 50 at least partially via the reinforcement structure 80. In another embodiment, the combination of the bottom foam portions of the right-side and left-side frames 82, 84 and the exposed portions of the same are insert molded into a foam part that defines the top section 50 of the completed helmet body 10. Accordingly, in a preferred embodiment the helmet body 10 includes multiple foam parts formed as individual layers of a unitary structure molded in successive steps to form said unitary structure. Advantageously, the right-side and left-side frames 82, 84 engage and fasten the different foam portions together.

Though the molding process described above involves molding the bottom portion 40 of the helmet body 10 first, and then molding the top portion 50 of the helmet body 10, other suitable sequences can be used to mold the helmet body 10. For example, in one embodiment, foam can be injection molded about the top portions of the right and left side frames 82, 84, while leaving the bottom portions of said frames 82, 84 exposed. Then, foam having a different density can be injection molded about the exposed bottom portions of the right and left side frames 82, 84, as well as about the previously formed foam part molded about the top portions of the frames 82, 84.

In a preferred embodiment, the foam used to form the bottom section 40 of the body 10 has a different density than the foam used to form the top section 50. In one embodiment, the foam used to form the bottom section 40 has a higher density than the foam used to form the top section 50. In still another embodiment, the bottom section 40 can be formed with a plurality of foam sections of different densities. For example, in one embodiment a first portion of the frames 82, 84 can be insert molded into a first foam section having a first density. Similarly, a second portion of the frames 82, 84 can be insert molded into a second foam section having a second density. Additionally, a third portion of the frames 82, 84 can be insert molded into a third foam section having a third density. The first, second and third foam sections can then be interconnected with each other via the frames 82, 84 or subsequent foam sections injection molded about the frames 82, 84 and at least one of the first, second and third foam sections. Likewise, the top section 50 can be formed with a plurality of foam sections of different densities. Accordingly, different portions of the helmet body 10 can be constructed having a selected foam density. Advantageously, the foam density of specific areas of the helmet body 10 can be optimized to reduce weight and provide a unitary composite structure.

In one embodiment, the lower-density foam is first injection molded about a portion of the frames 82, 84, and then the higher-density foam is injection molded about another portion of the frames 82, 84. In another embodiment, the higher-density foam section is first injection molded about a portion of the frames 82, 84, then the lower-density foam is injection molded about another portion of the frames 82, 84. This process can be repeated until the helmet body 10 has been fully formed.

As discussed above, and shown in FIG. 4A, in one embodiment, the structure of linear material 81 can be formed without a reinforcement member 88. In the illustrated embodiment, the structure of linear material 81 includes a least one loop 83 of linear material. Preferably, the loops 83 are disposed on the structure 81 at locations where one foam part having a first density will meet with a second foam part having a second density different from the first density. Accordingly, the loops 83 are preferably positioned along the foam density "border". Advantageously, the loops 83 strengthen the engagement between the structure of linear material 81 and the foam parts in the completed helmet body 10.

FIG. 4B illustrates another embodiment of the reinforcement structure 80 with a frame 82' of linear material, without a reinforcement member 88. In the illustrated embodiment, the frame 82' corresponds to a right-side frame of a helmet body and is defined by a unidirectional continuous filament. In the illustrated embodiment, the helmet body is in an intermediate manufacturing step, where the bottom foam portion 40 has been molded onto the frame 82', as further discussed below. A left-side frame is preferably a mirror image of the frame 82' and is therefore not shown.

As discussed above, the frame 82' of the helmet body 80 can be made of a continuous unidirectional filament. In another embodiment, shown in FIG. 4C, the frame 82" can consist of multiple loops 82*a'* of linear material, wherein each of the loops 82*a'* is attached to at least another of the loops 82*a'*, so that the loops 82*a'* of linear material overlap with each other. In a preferred embodiment, the loops 82*a'* overlap over a length of between about 3 cm and about 4 cm. However, the loops 82*a'* can overlap over a longer or shorter distance.

Figure 5A:
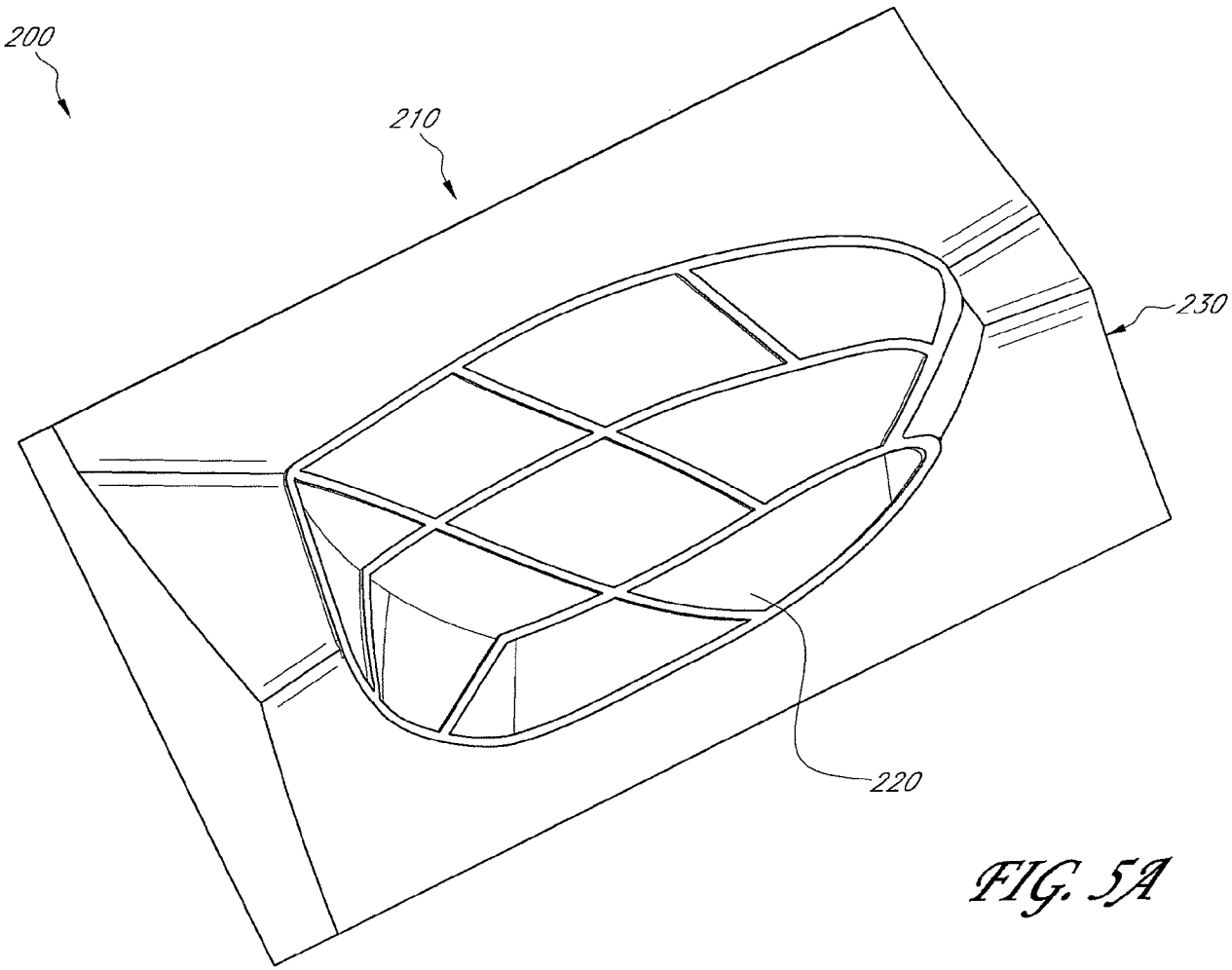
FIG. 5A is a schematic perspective front view of a top portion of a mold for forming the reinforcement structure shown in FIGS. 4A-4C.
Figure 5B:
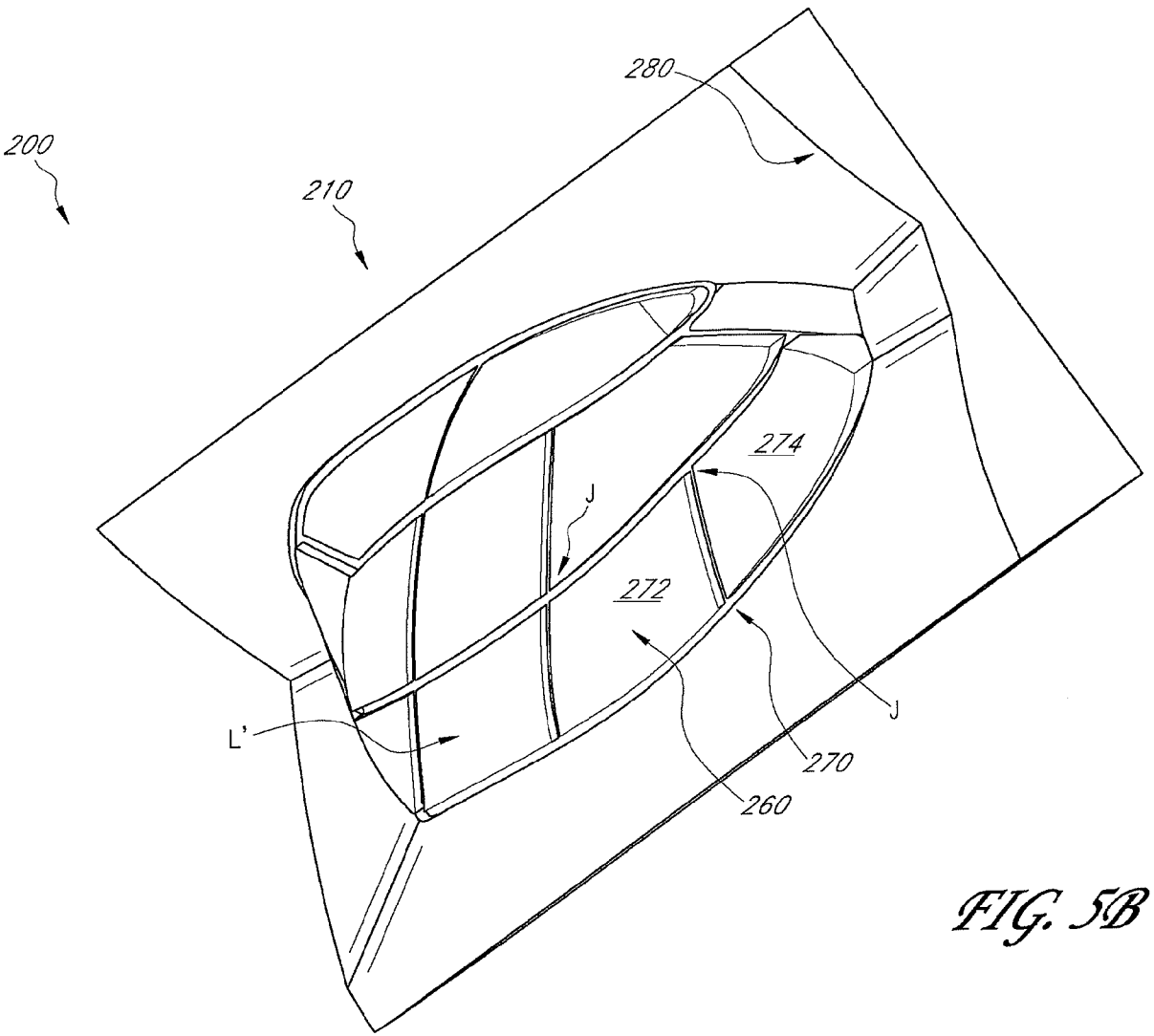
FIG. 5B is a schematic perspective front view of a bottom portion of a mold for forming the reinforcement structure shown in FIG. 4A-4C.

FIGS. 5A-5B illustrate a mold 200 used to form the structure of linear material 81. In the illustrated embodiment, the mold 200 is used to form a right-side reinforcement frame 82', 82" for a helmet body. However, a similarly constructed mold can be used to form a left-side reinforcement frame of the helmet body.

The mold 200 includes a top portion 210 and a bottom portion 250. The top portion 210 defines an outer frame surface 220 and an inner frame surface (not shown) on a side opposite the outer frame surface 220. The top portion 210 also has an outer edge 230.

The bottom portion 250 defines an inner frame surface 260, which includes a plurality of grooves 270 formed thereon. The grooves 270 are oriented to provide a desired layout L', which preferably corresponds to the layout L of the frame 82' of linear material. However, one of ordinary skill in the art will recognize that the grooves 270 can be oriented to provide any desired layout, such as the layout L of the right-side frame 82 and left-side frame 84 described above. The bottom portion 250 also includes and outer edge 280. The top and bottom portions 210, 250 of the mold 200 preferably couple to each other along their edges 230, 280 to form a closed mold.

In one embodiment, continuous linear material is preferably disposed in the grooves 270 of the bottom portion 250 and wound around junctions between intersecting grooves 270, in order to define the desired layout L. In one embodiment, pins are inserted at the junctions J between grooves 270, and the linear material wound around the pins to aid in laying the linear material along the grooves 270. Once the desired layout L is obtained, and the frame 82' cured, said pins can be removed. Such a process can be used to form, for example, the frame 82' shown in FIG. 4B.

In another embodiment, discrete loops of linear material can be disposed along the grooves 270 so as to define the desired layout L. For example a loop of linear material can be laid along a set of grooves 270 that define one section 272 of the layout L. Another loop of linear material can then be laid along another set of grooves 270 that define another section 274 of the layout L. Preferably the loops of linear material are laid within the grooves 270 so that at least a portion of each loop overlaps with a portion of another loop. In a preferred embodiment, said loops of linear material overlap between about 3 cm and about 4 cm. However, in another embodiment, the loops of linear material can overlap less than 3 cm, or more than 4 cm. Such a process can be used to form, for example, the frame 82" shown in FIG. 4C.

After the linear material has been laid within the grooves 270 250, the top portion 210 is coupled to the bottom portion 250 of the mold 200. The linear material within the grooves 270 can then be cured to provide a frame 81, 82', 82" that is substantially rigid. For example, the linear material with the grooves can be heated to harden the linear material into a substantially rigid structure.

Figure 6A:
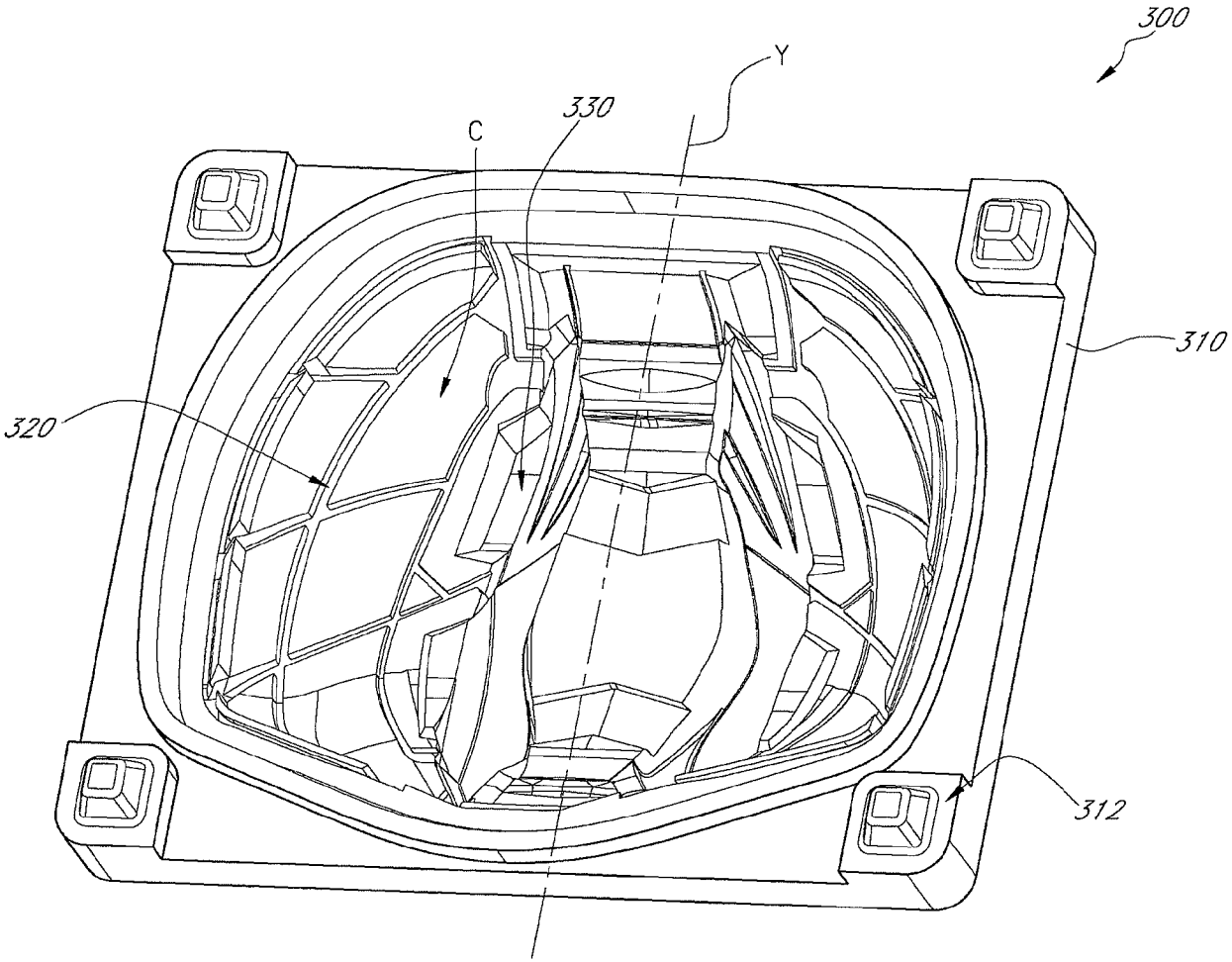
FIG. 6A is a schematic front view of a bottom portion of a mold for forming a foam portion about the reinforcement structure shown in FIGS. 4A-4C.
Figure 6B:
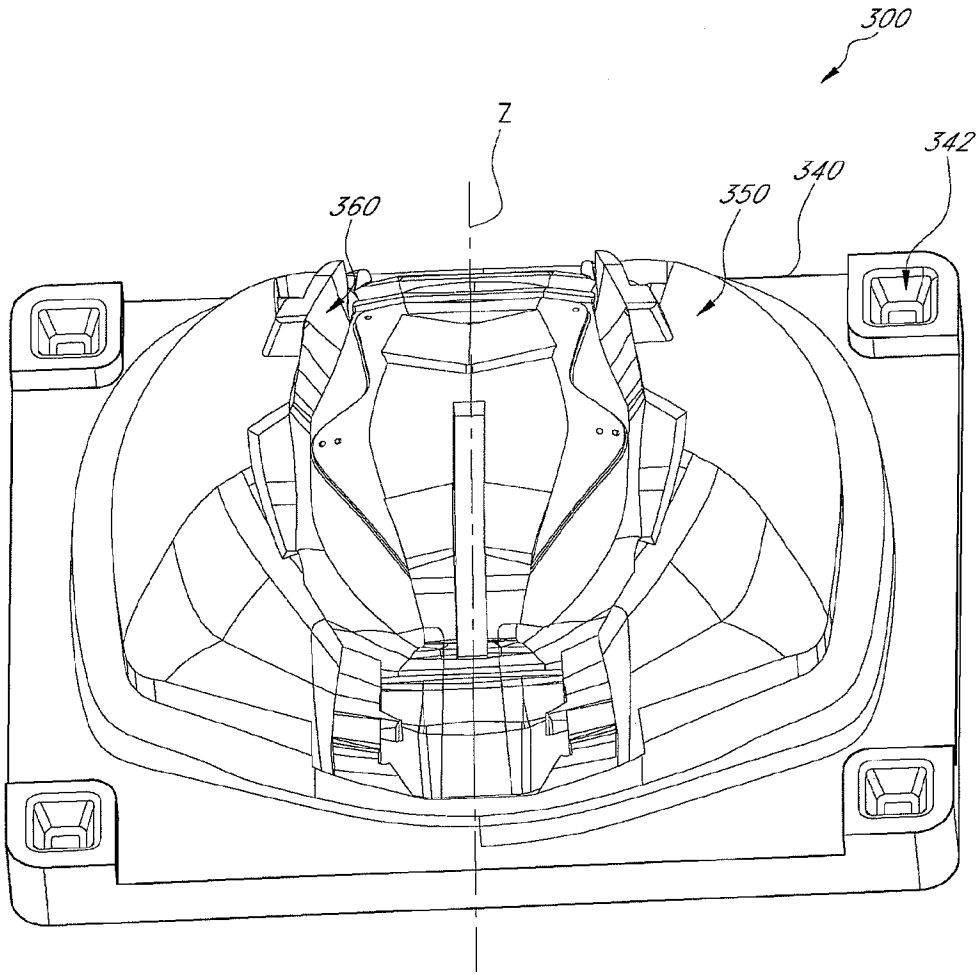
FIG. 6B is a schematic front view of a top portion of a mold for forming a foam portion about the reinforcement structure shown in FIGS. 4A-4C.

FIGS. 6A-6B illustrate one embodiment of a mold 300 used to form a foam section about the structure of linear material 81 or frame 82, 82', 82". Specifically, the mold 300 is sized to form the bottom foam portion 40 about the structure of linear material 81.

The mold 300 preferably includes a bottom portion 310 and a top portion 340. The bottom portion 310 is symmetrical about an axis Y, which divides the bottom portion 310 into two identical halves, and includes fastening members 312 for fastening the bottom portion 310 to the top portion 340. Preferably, each half of the bottom portion 310 includes a concave surface C with grooves 320 formed therein. The grooves 320 form a layout L" equal to the layout L of the structure of linear material 81 or reinforcement frames 82, 82', 82", 84. Each half of the bottom portion 310 also has a recessed portion 330 formed adjacent the layout L" of grooves 320. The recessed portion 330 is preferably recessed relative to the concave surface C.

The top portion 340 of the mold 300 is likewise symmetrical about an axis Z, which divides the top portion 340 into identical halves, and includes fastening members 342 sized to engage the fastening members 312 of the bottom portion 310, so as to form the assembled mold 300. The top portion 340 preferably includes a convex surface 350 with a contour corresponding to the contour defined by the concave surface C. The top portion 340 also includes protrusions 360, which extend out from the contour of the convex surface 350.

Figure 7A:
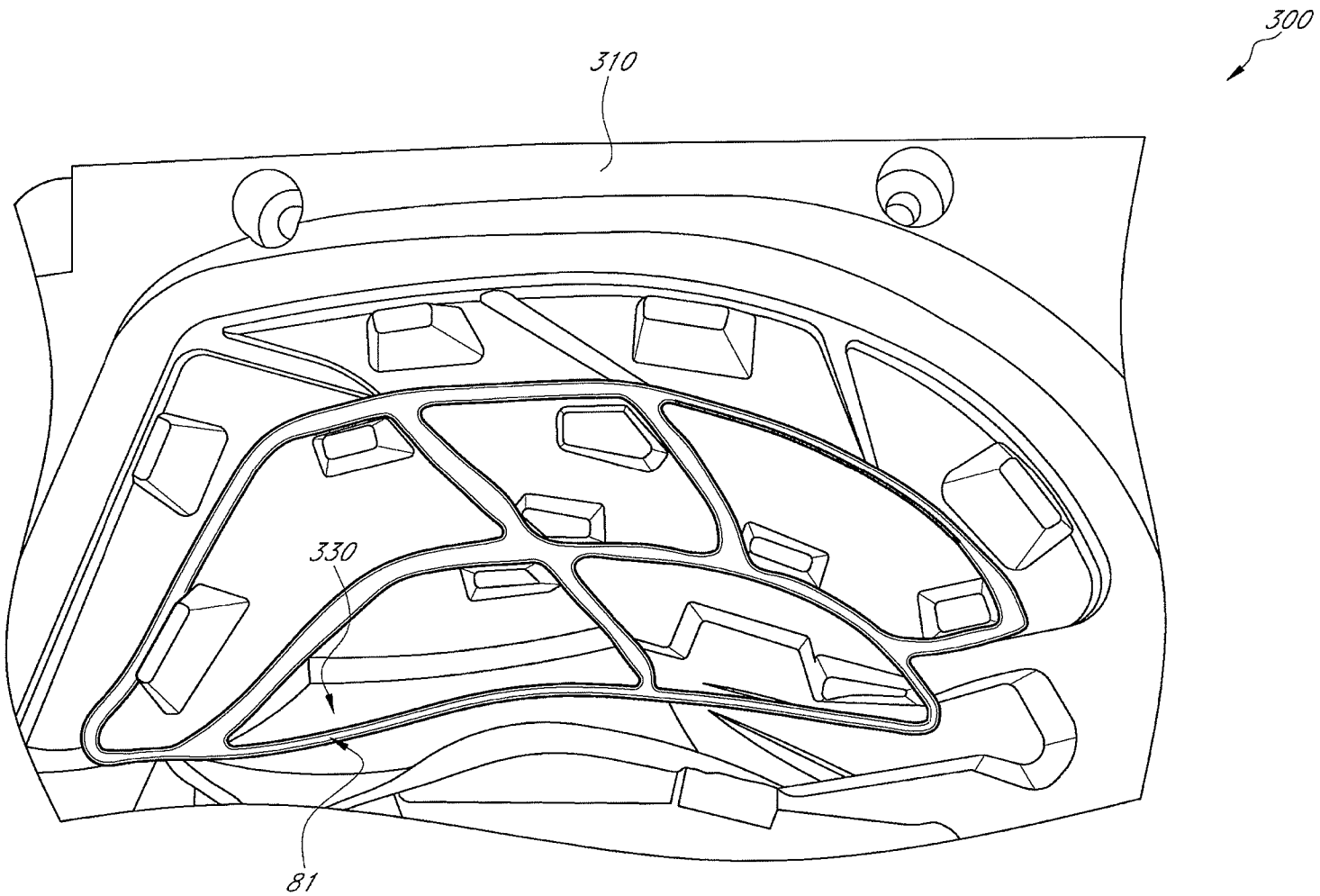
FIG. 7A is a schematic front view of a bottom portion of the mold in FIG. 6A, with a reinforcement structure disposed therein, prior to formation of the foam portion about the reinforcement structure.

Once the structure of linear material 81 has been formed using the mold 200, the structure 81 is placed in the grooves 320 of the bottom portion 310 of the mold 300. As the layout L" of the grooves 320 is substantially equal to the layout L of the structure 81, the structure 81 readily fits within the grooves 320. Preferably, the structure 81 fits within the layout L" of the grooves 320 such that a portion of the structure 81 is not disposed in the grooves 320, but instead extends over the recessed portion 330, as shown in FIG. 7A.

Figure 7B:
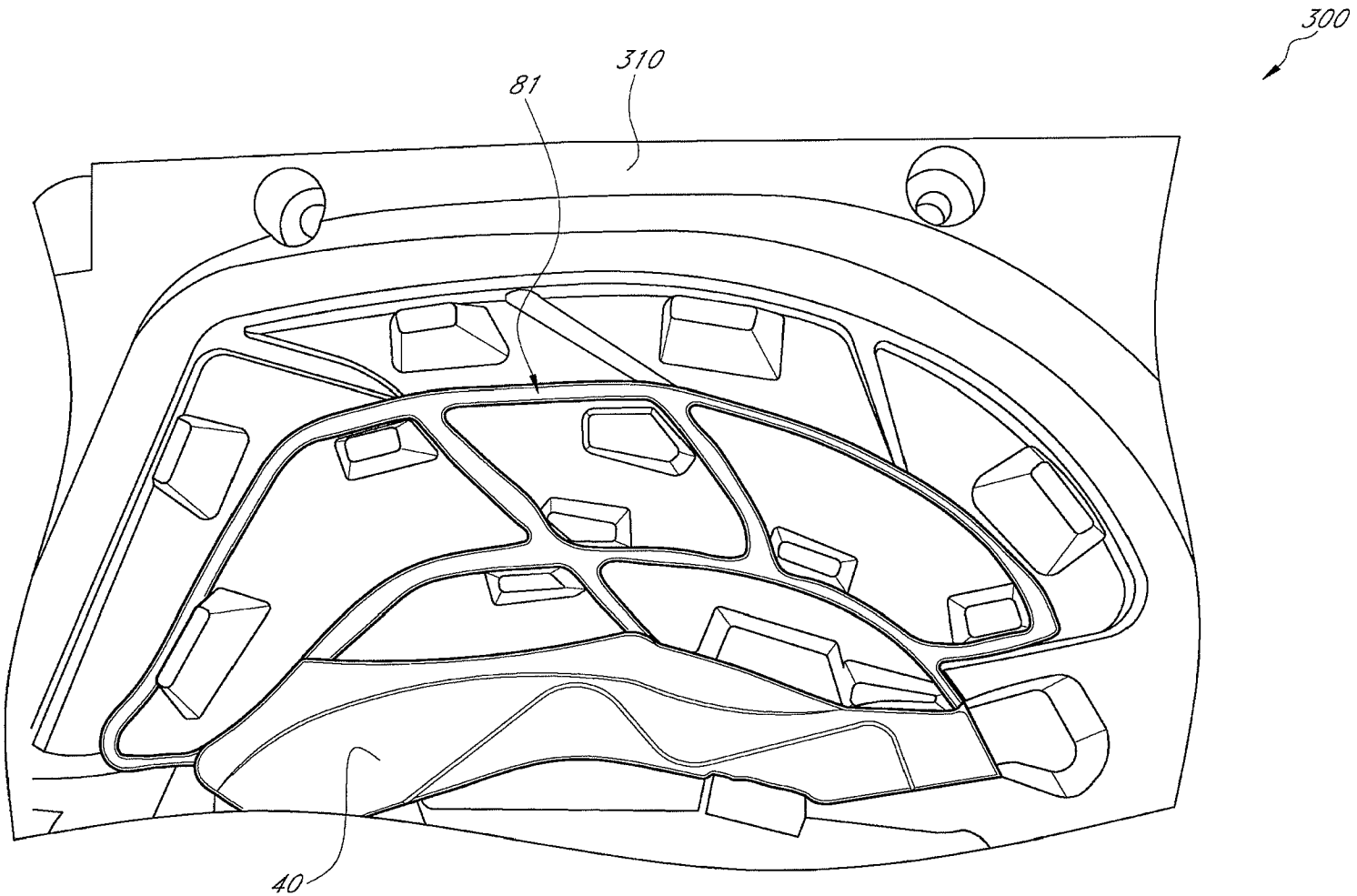
FIG. 7B is a schematic front view of the bottom portion in FIG. 7A, following the formation of the foam portion about the reinforcement structure.

The top portion 340 is coupled to the bottom portion 310. In one embodiment, the convex surface 350 of the top portion 340 contacts the concave surface C of the bottom portion 310, which maintains the structure 81 in place and inhibits its withdrawal from the layout L" of the grooves 320. Foam of a desired density is then injected into the recessed portion 330 so as to form the bottom portion 40 of the helmet body 10. As shown in FIG. 7B, the bottom portion 40 is formed about the exposed portion of the structure 81 that extended over the recessed portion 330.

The assembly of the frame 82, 82', 82" and bottom portion 40 can then be withdrawn from the mold 300 and transferred to another mold (not shown) to form the top portion 50 of the helmet body 10. This mold can be similar in construction to the mold 300 and include a recessed portion over which the exposed portion of the structure 81 can be placed, so that foam can similarly be injection molded about the exposed portions of the structure.

Figure 8A:
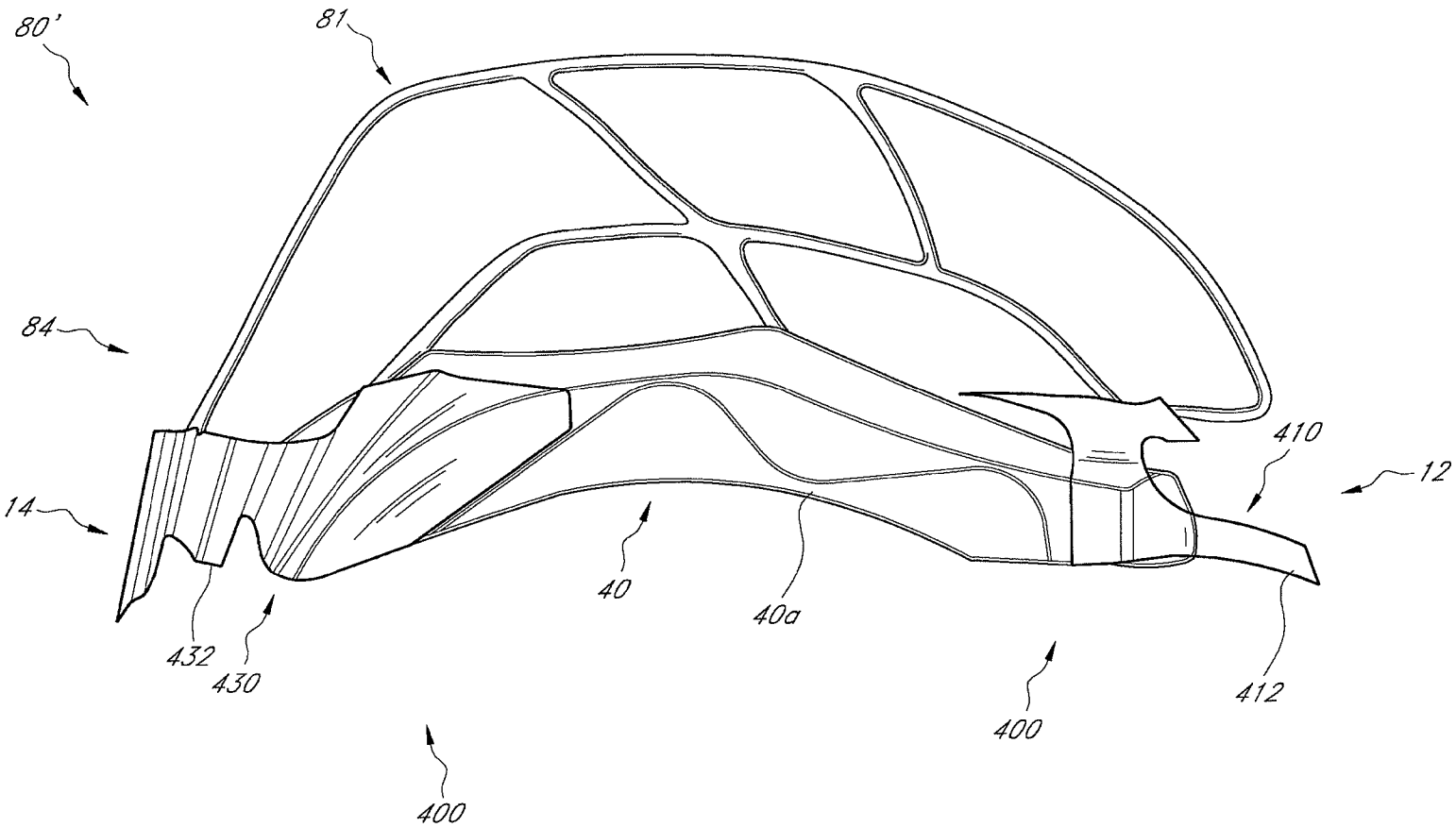
FIG. 8A is a schematic rear view of another embodiment of a reinforcement structure for a bicycle helmet.

FIG. 8A-H illustrate another embodiment of a reinforcement structure 80', As shown in FIG. 8A, the reinforcement structure 80' includes a structure of flexible linear material 81 about which a bottom foam section 40 has been molded, as described above. In the illustrated embodiment, the bottom foam section 40 includes a high density foam. However, in other embodiments, the bottom foam section 40 can include a lower density foam. In the illustrated embodiment, the reinforcement structure 80' is for a left-side frame 84 of the helmet body 10. However, as discussed above, the reinforcement structure 80' for a right-side frame 82 would be a mirror image of the structure illustrated in FIG. 8A. Accordingly, the reinforcement structure 80' for a right-side frame is not shown.

With continued reference to FIG. 8A, the reinforcement structure 80' also includes shells or panels 400 attached to the foam portion 40. In the illustrated embodiment, a front shell 410 is attached to a surface of the bottom foam portion 40 at the front end 12, such that at least a portion of the front shell 410 is in contact with the surface of the bottom foam portion 40 while another portion of the shell 410 is free. In one embodiment, about ½ of the front shell 410 is bonded to the surface of the bottom foam portion 40 and about ½ of the front shell 410 is unbonded (e.g., exposed). Likewise, a rear shell 430 is attached to a surface of the bottom foam portion 40 at the rear end 14, such that at least a portion of the rear shell 430 is in contact with the surface of the bottom foam portion 40, while another portion of the shell 430 is free. In one embodiment, about ½ of the rear shell 430 is bonded to the surface of the bottom foam portion 40 and about ½ of the shell 430 is unbonded (e.g., exposed). Though the illustrated embodiment includes two shells, the front and rear shells 410, 430, one or ordinary skill in the art will recognize that the reinforcement structure 80' can include more or fewer shells.

In the illustrated embodiment, the shells 410, 430 are attached to an inner surface 40a of the bottom foam portion 40, which is the generally concave surface facing a user's head once the helmet body 10 is complete. However, in another embodiment, the shells 410, 430 can be attached to an outer surface of the bottom foam portion 40 of the helmet body 10.

Figure 8B:
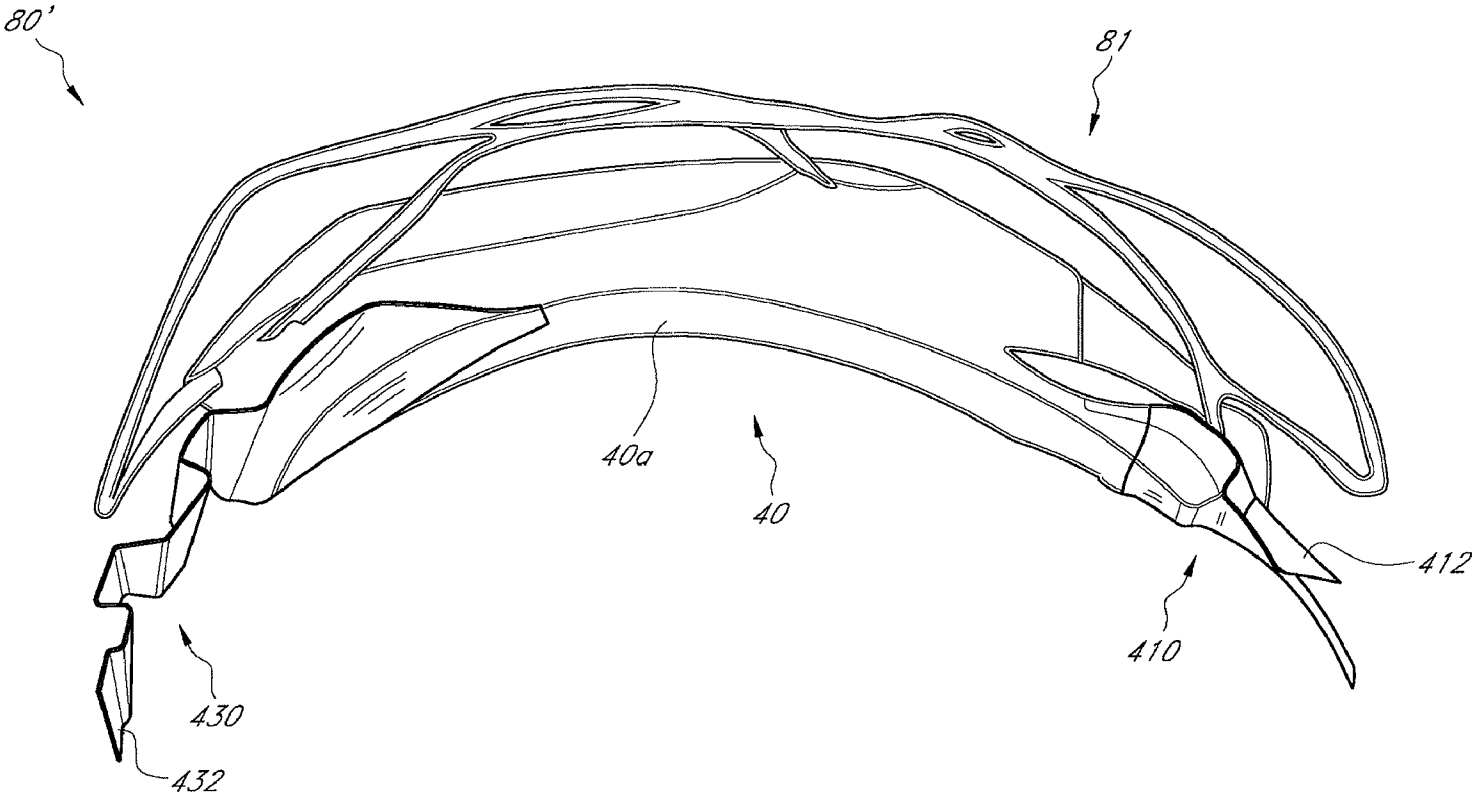
FIG. 8B is a schematic top and rear side view of the reinforcement structure in FIG. 8A.
Figure 8C:
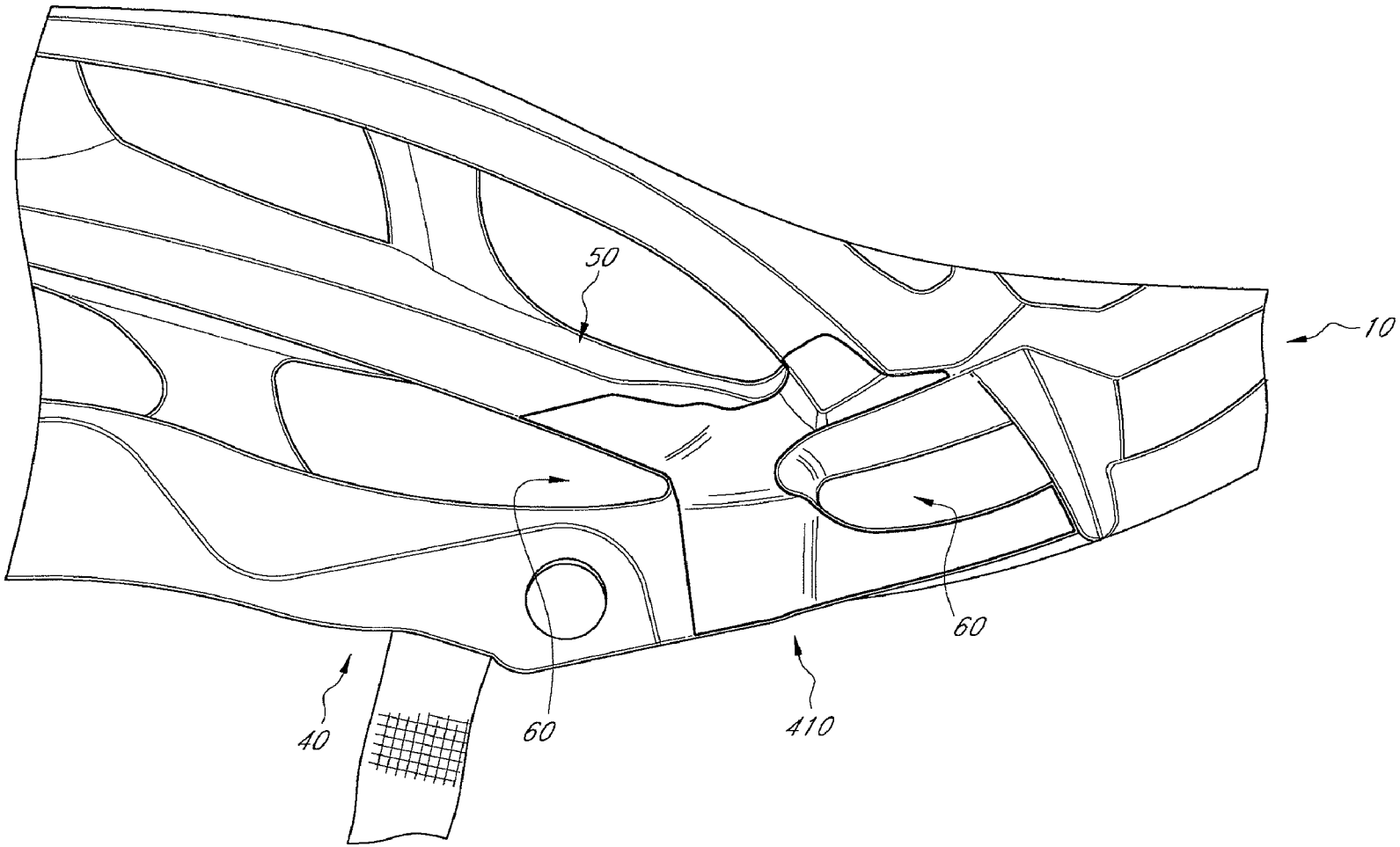
FIG. 8C is a partial schematic view of a front portion of a helmet body incorporating the reinforcement structure of FIG. 8A.
Figure 8D:
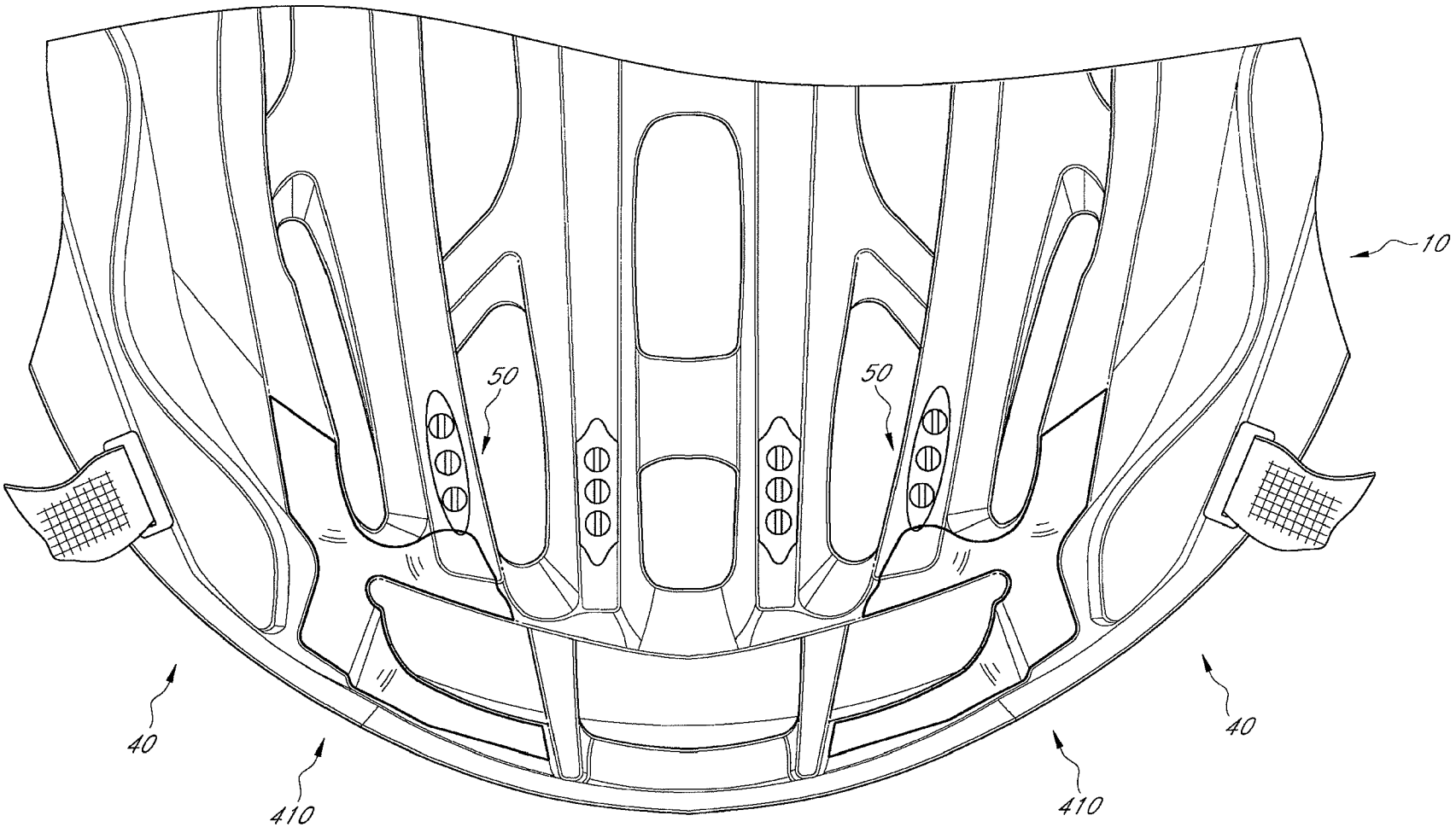
FIG. 8D is a partial schematic view of a front portion of a helmet body incorporating the reinforcement structure of FIG. 8A.

As shown in FIGS. 8A-8B, the front shell 410 preferably has a contour 412 that allows the shell 410 to be bonded to other sections of the helmet body 10. FIGS. 8C-8D, for example, show the front shell 410 attached to different sections of a completed helmet body 10. In the illustrated embodiment, the front shell 410 is bonded to the bottom foam section 40, which preferably includes foam having a first density, and is bonded to the top foam section 50, which preferably includes foam having a second density different from the first density. Accordingly, the front shell 410 can be a bridge between different sections of the helmet body 10 having different densities, and provide further structural support to the helmet body 10. Additionally, the contour 412 of the front shell 410 preferably helps define at least some of the vent openings 60 in the helmet body 10.

Figure 8E:
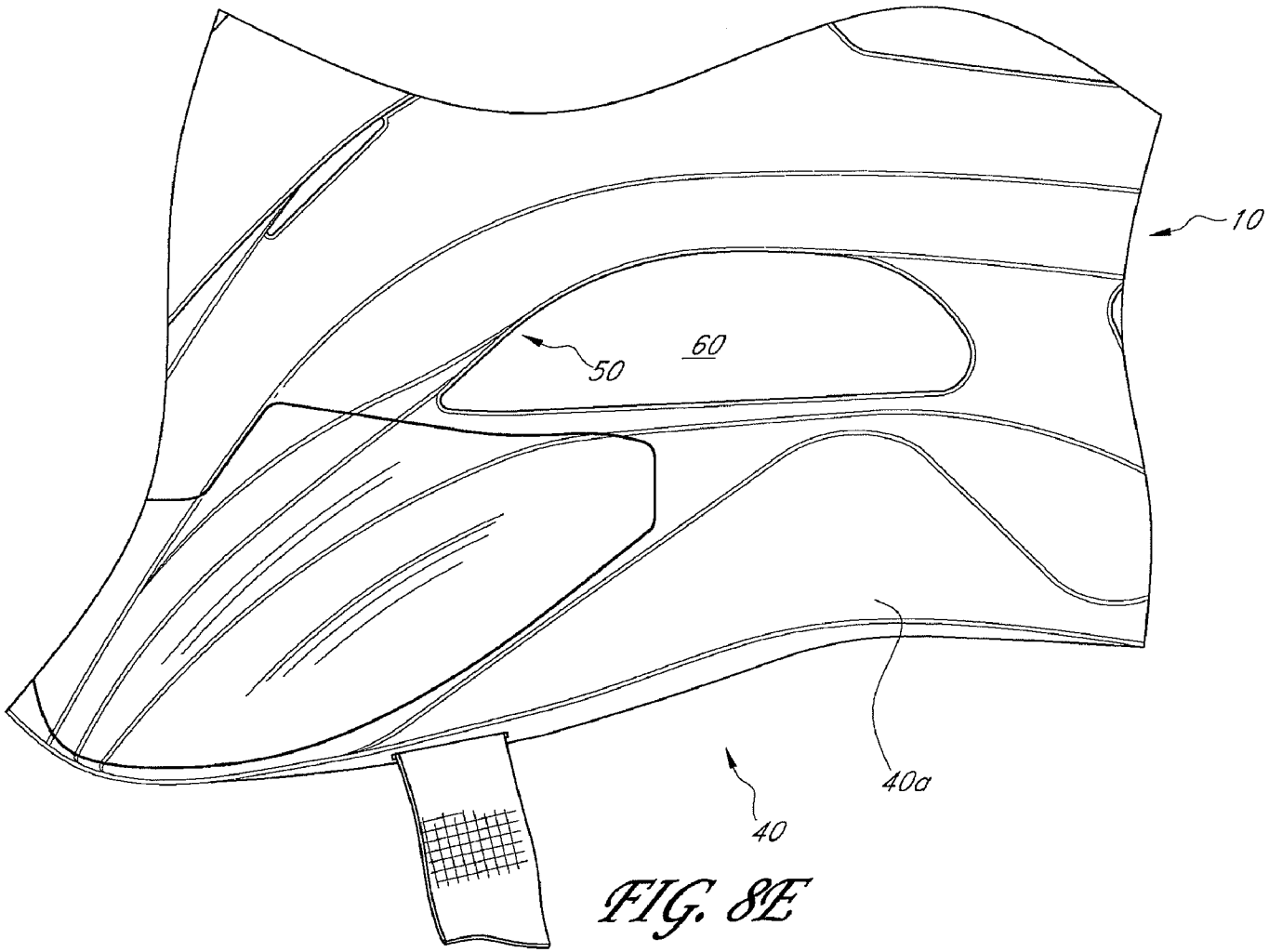
FIG. 8E is a partial schematic view of a rear portion of a helmet body incorporating the reinforcement structure of FIG. 8A.
Figure 8F:
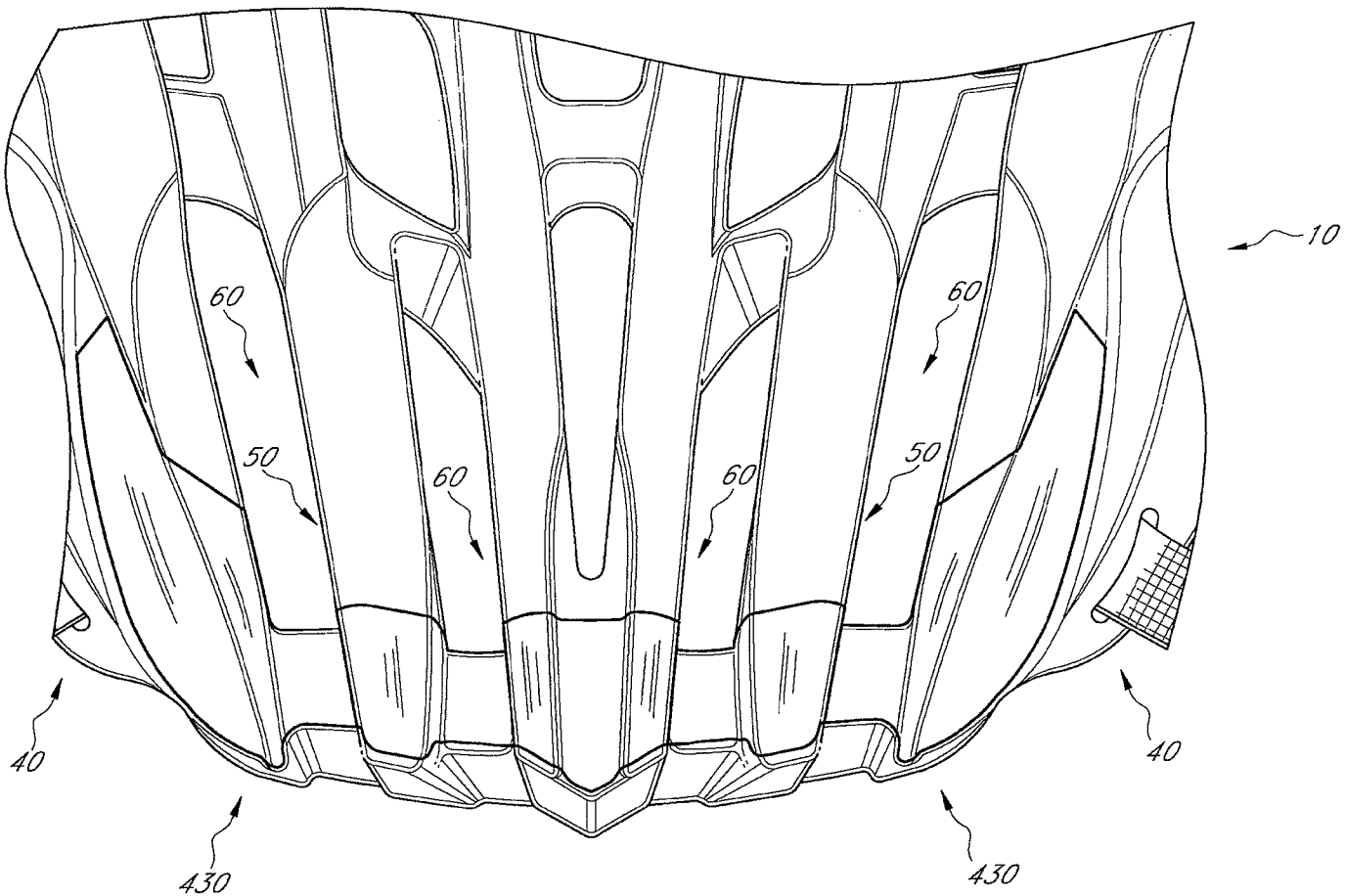
FIG. 8F is a partial schematic view of a rear portion of a helmet body incorporating the reinforcement structure of FIG. 8A.

Likewise, as shown in FIGS. 8A-8B, the rear shell 430 preferably has a contour 432 that preferably allows the rear shell 430 to be bonded to other sections of the helmet body 10. FIGS. 8E-8F, for example, show the rear shell 430 attached to different sections of the completed helmet body 10. Specifically, FIGS. 8E-8F show the rear shell 430 bonded to the bottom foam section 40 and to the top foam section 50. As noted above, the bottom and top foam sections 40, 50 of the helmet body 10 can have different densities. Accordingly, the rear shell 430 can provide additional structural support to the helmet body 10 and function as a bridge between different foam sections having different densities. Additionally, the rear shell 430 preferably helps define at least one of the vent openings 60.

In the illustrated embodiment, the front and rear shells 410, 430 have predetermined contours 412, 432 corresponding to the shapes of the different foam sections 40, 50 to which the shells 410, 430 attach. However, in another embodiment, the shells 410, 430 can be flexible panels having a generally planar shape that can be bent to conform to the shape of the different foam sections 40, 50.

In one embodiment, the shells 410, 430 are insert molded to the bottom foam portion 40 having a first density, using a similar process for insert molding the structure of linear material, as described above, to obtain the assembly shown in FIG. 8A. This assembly can then be insert molded into a second foam part, such as the top foam portion 50, having a second density different than the first density. Accordingly, a completed helmet body 10, as shown in FIGS. 8D-8F, can be obtained.

In another embodiment, the shells 410, 430 can be attached to the helmet body 10 after the different foam sections, such as the bottom and top foam portions 40, 50, have been insert molded about the structure of linear material 81. For example, once the completed helmet body 10 is formed, the shells 410, 430 can be applied to the body 10 so that the shells 410, 430 bridge across and connect the different foam sections 40, 50 having different foam densities. The completed helmet body 10 assembly can then be heated to bond the shells 410, 430 to the foam sections 40, 50. In one embodiment, the shells 410, 430 bond to the foam portions 40, 50 via an adhesive or ink on a surface of the shells 410, 430 which is activated upon heating. In another embodiment, an adhesive can be applied to the surface 40*a* of the foam portion 40, and the shells 410, 430 applied to said surface 40*a*. However, other suitable methods for bonding the shells 410, 430 to the foam portion 40, 50 can be used. For example, the injection molding process can alter the surface of the shells 410, 430, allowing it to bond to the foam portion 40, 50.

In one embodiment, the shells 410, 430 can comprise a polycarbonate material configured to withstand temperatures commonly present during the foam molding process. In another embodiment, the shells 410, 430 can comprise a polyvinyl chloride (PVC) material, or a polyethylene terephtalate glycol (PETG) material. However, other suitable materials having a desired strength, rigidity and weight can be used, including other plastic materials.

Figure 9:
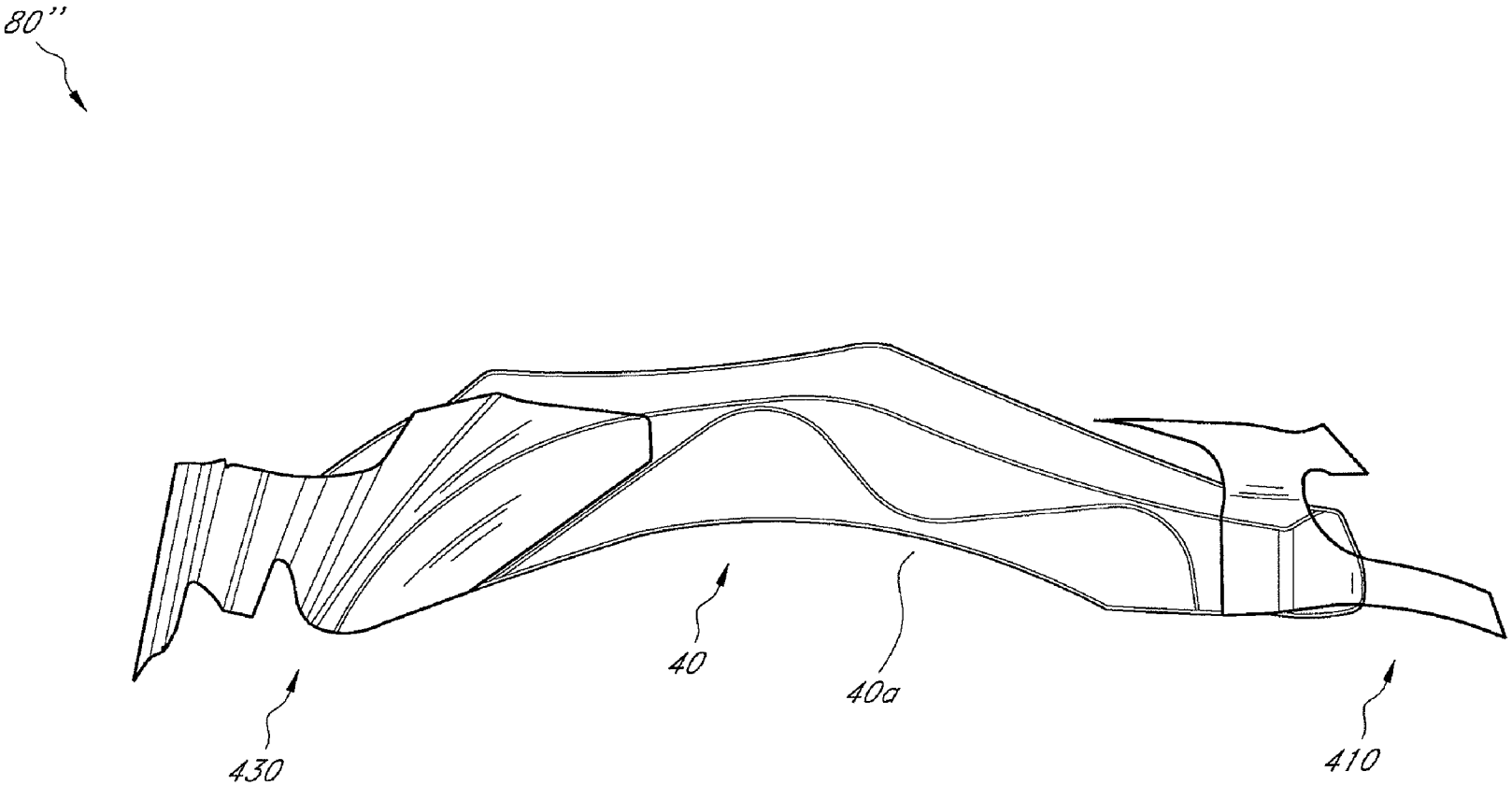
FIG. 9 is a rear view of another embodiment of a reinforcement structure for a bicycle helmet.

In the embodiment illustrated in FIGS. 8A-8F, the shells 400 are used in addition to the structure of linear material 81 to form the reinforcement structure 80'. In another embodiment, a reinforcement structure 80" includes only the shells 400, without the structure of linear material 81, as shown in FIG. 9. In the illustrated embodiment, the front and rear shells 410, 430 are attached to the bottom foam portion 40, which has a first density, to form an intermediate assembly. As described above, this intermediate assembly can then be insert molded into another foam section having a second density, which may differ from the first density.

In one embodiment, shown in FIG. 1B, an outer shell 500 preferably covers at least a portion of an outer surface of the body 10 and, thus, defines at least a portion of the outer surface of the helmet 100. In one embodiment, the shell is continuous and overlays an outer surface of the body 10. The shell can provide protection to the body 10 and improve the overall appearance of the helmet 100. In addition, the shell may also provide an energy-absorbing function. Further, the shell can function as an external frame of the helmet body 10. In one embodiment, the shell can be a relatively thin layer of a plastic material. Additionally an average thickness of the shell can desirably be substantially less than an average thickness of the body 10. In one arrangement, the shell may be injection molded onto the helmet body 10 after it has been formed in a previous process step.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present helmet has been described in the context of particularly preferred embodiments, the skilled artisan will appreciate, in view of the present disclosure, that certain advantages, features, and aspects of the helmet may be realized in a variety of other applications, many of which have been noted above. Additionally, it is contemplated that various aspects and features of the invention described can be practiced separately, combined together, or substituted for one another, and that a variety of combination and sub-combinations of the features and aspects can be made and still fall within the scope of the invention. Additionally, it is contemplated that the sequence of steps in the construction of the helmet can be varied and still fall within the scope of the invention. For example, the different sections of the helmet body can be formed in any desirable sequence, such as forming the top section of the helmet first and then forming the bottom section of the helmet. Thus, it is intended that the scope of the present invention herein disclosed should not be limited by the particular disclosed embodiments described above, but should be determined only by a fair reading of the claims.

What is claimed is:

1. A bicycle helmet, comprising:

a body having a concave inner surface configured to permit the helmet to fit a user's head, the body having a first bottom section comprising a first material with a first material density and a second top section comprising a second material with a second material density different from the first material density, the first material density being greater than the second material density, the first bottom section extending from the inner surface of the body to an outer surface of the body and the second top section extending from the inner surface of the body to the outer surface of the body; and a reinforcement structure disposed in the body, wherein the reinforcement structure engages the first and second sections of the body.

2. The helmet of claim 1, wherein the reinforcement structure comprises a continuous unidirectional filament.

3. The helmet of claim 2, wherein the reinforcement structure further comprises at least one shell attached to the first and second sections of the body.

4. The helmet of claim 3, further comprising at least one ventilation opening defined within the body configured to allow air to pass therethrough onto the head of a user, said ventilation opening defined at least in part by the reinforcement structure.

5. The helmet of claim 1, wherein at least one of the first and second sections of the body comprises an expanded foam material.

6. The helmet of claim 1, wherein the first material density is between about 98 grams/liter and about 112 grams liter.

7. The helmet of claim 1, wherein the second material density is between about 60 grams/liter and about 98 grams/liter.

8. The helmet of claim 1, further comprising an outer shell disposed over at least a portion of an outer surface of the body.

9. A bicycle helmet, comprising:

a body having a plurality of sections, a first bottom section of the body comprising a first material with a first material density that is different from a second material density of a second top section of the body comprising a second material, the first material density being greater than the second material density, the first bottom section extending from an inner surface of the body to an outer surface of the body and the second top section extending from the inner surface of the body to the outer surface of the body; and a reinforcement structure, at least a portion of which is embedded within said body, wherein the reinforcement structure extends through adjacent sections so that the sections are interconnected at least partially by the reinforcement structure.

10. The bicycle helmet of claim 9, wherein the reinforcement structure comprises a continuous unidirectional filament.

11. The bicycle helmet of claim 9, wherein the first material density is between about 60 grams/liter and about 112 grams/liter.

12. The bicycle helmet of claim 11, wherein the first material density is about 104 grams/liter.

13. The bicycle helmet of claim 9, wherein the second material density is between about 60 grams/liter and about 112 grams/liter.

14. The bicycle helmet of claim 13, wherein the second material density is about 72 grams/liter.

15. A bicycle helmet, comprising:

a body having a first bottom section comprising a first material having a first material density and a second top section comprising a second material having a second material density different from the first material density, the first material density being greater than the second material density, the first bottom section extending from an inner surface of the body to an outer surface of the body and the second top section extending from the inner surface of the body to the outer surface of the body; and a reinforcement structure comprising at least one shell attached to the first and second sections, wherein the reinforcement structure extends across the sections so that the sections are interconnected at least partially by the reinforcement structure.

16. The bicycle helmet of claim 15, wherein the at least one shell is attached to an inner surface of the first and second sections, said inner surface facing at least partially toward the head of a user when the helmet is worn.

17. The bicycle helmet of claim 15, wherein the reinforcement structure further comprises a structure of linear material embedded in the body.

18. The bicycle helmet of claim 17, wherein the structure of linear material is defined by a plurality of loops of material, one of said loops overlapping another of the loops at least partially to form said structure.

19. The bicycle helmet of claim 18, wherein said loops overlap between about 3 cm and about 4 cm.

20. The bicycle helmet of claim 15, wherein the first material density is between about 98 grams/liter and about 112 grams/liter.

21. The bicycle helmet of claim 20, wherein the first material density is about 104 grams/liter.

22. The bicycle helmet of claim 15, wherein the second material density is between about 60 grams/liter and about 98 grams/liter.

23. The bicycle helmet of claim 22, wherein the second material density is about 72 grams/liter.

24. A method for manufacturing a bicycle helmet, comprising:

forming a first bottom body section comprising a first material having a first material density, the first section engaging at least a portion of a reinforcement structure; and forming a second top body section comprising a second material having a second material density different than the first material density, the first material density being greater than the second material density, the second body section engaging the first body section and at least a portion of the reinforcement structure to form a helmet body, the reinforcement structure interconnecting the first and second body sections, wherein the first bottom body section extends from an inner surface of the helmet body to an outer surface of the helmet body and the second top body section extends from the inner surface of the helmet body to the outer surface of the helmet body.

25. The method of claim 24, wherein forming the first and second body sections includes forming a foam material about the reinforcement structure.

26. The method of claim 25, wherein the foam material is injection molded about the reinforcement structure.

27. The method of claim 24, wherein engaging the first and second body sections to the reinforcement structure includes attaching a shell to an inner surface of the first and second body sections, the shell extending across a junction between the first and second body sections.

28. The method of claim 24, wherein forming the first and second body sections includes forming at least one ventilation opening in one or both of the first and second body sections, the ventilation opening defined at least in part by the reinforcement structure.

29. The method of claim 24, further comprising attaching an outer shell to at least a portion of an outer surface of one or both of the first and second body sections.

* * * * *

UNITED STATES PATENT AND TRADEMARK OFFICE

CERTIFICATE OF CORRECTION

PATENT NO. : 7,913,325 B2
APPLICATION NO. : 11/425350
DATED : March 29, 2011
INVENTOR(S) : Christopher Bullock It is certified that error appears in the above-identified patent and that said Letters Patent is hereby corrected as shown below:

At column 1, line 9, please delete "STRUCUTRE," and insert --STRUCTURE,--, therefor.

At column 1, line 12, please delete "STRUCUTRE," and insert --STRUCTURE,--, therefor.

At column 5, line 20, please delete "60 g" and insert --60--, therefor.

At column 5, line 20, please delete "bout" and insert --about--, therefor.

At column 6, line 29, please delete "80bpreferably" and insert --80b preferably--, therefor.

At column 6, line 57, please delete "80f ," and insert --80f,--, therefor.

At column 7, line 32, please delete "80f ," and insert --80f,--, therefor.

At column 7, line 48, please delete "80f ," and insert --80f,--, therefor.

At column 7, line 51, please delete "80f ," and insert --80f,--, therefor.

At column 7, line 53, please delete "80f ," and insert --80f,--, therefor.

At column 7, line 54, please delete "80f ," and insert --80f,--, therefor.

At column 7, line 61, please delete "80f ," and insert --80f,--, therefor.

At column 13, lines 5-6, please delete "terephtalate" and insert --terephthalate--, therefor.

At column 14, line 25, in Claim 6, please delete "grams liter." and insert --grams/liter.--, therefor.

Signed and Sealed this
Seventh Day of February, 2012

David J. Kappos

David J. Kappos
*Director of the United States Patent and Trademark Office*